US009600961B2

(12) United States Patent
Acres

(10) Patent No.: US 9,600,961 B2
(45) Date of Patent: Mar. 21, 2017

(54) PLAYER-BASED COMPENSATION

(75) Inventor: John F. Acres, Corvallis, OR (US)

(73) Assignee: PATENT INVESTMENT & LICENSING COMPANY, Las Vegas, NV (US)

( * ) Notice: Subject to any disclaimer, the term of this patent is extended or adjusted under 35 U.S.C. 154(b) by 1315 days.

(21) Appl. No.: 12/166,156

(22) Filed: Jul. 1, 2008

(65) Prior Publication Data

US 2009/0124358 A1 May 14, 2009

Related U.S. Application Data

(60) Provisional application No. 60/987,293, filed on Nov. 12, 2007.

(51) Int. Cl.
*A63F 9/00* (2006.01)
*G07F 17/32* (2006.01)

(52) U.S. Cl.
CPC ..... *G07F 17/3225* (2013.01); *G07F 17/32* (2013.01); *G07F 17/3239* (2013.01); *G07F 17/3244* (2013.01)

(58) Field of Classification Search
None
See application file for complete search history.

(56) References Cited

U.S. PATENT DOCUMENTS 2,669,389 A 2/1954 Mesi et al.
3,124,355 A 3/1964 Mentzer et al.
3,124,674 A 3/1964 Edward et al.
3,684,290 A 8/1972 Wayne
3,727,213 A 4/1973 Kurtenbach
3,751,040 A 8/1973 Carey
4,240,635 A 12/1980 Brown
4,254,404 A 3/1981 White
4,433,844 A 2/1984 Hooker et al.
4,836,546 A 6/1989 DiRe et al.
4,887,813 A 12/1989 Chiles, III et al.
5,022,653 A 6/1991 Suttle et al.
5,024,439 A 6/1991 Okada
5,027,102 A 6/1991 Sweeny
5,031,914 A 7/1991 Rosenthal
5,078,405 A 1/1992 Jones et al.
(Continued)

FOREIGN PATENT DOCUMENTS

EP 0 141 264 A2 5/1985
EP 0 896 304 A2 2/1999
(Continued)

OTHER PUBLICATIONS

Acres, John, The Future of Gaming, Where Will You be in 10 Years?, Slot Operations Management / Casino Enterprise Management, Jul. 2007, pp. 8-10, 12.
(Continued)

*Primary Examiner* — Seng H Lim
(74) *Attorney, Agent, or Firm* — Marger Johnson

(57) ABSTRACT

Embodiments of the invention are directed toward a system that rewards identified players with certain benefits that can be used within a base game of a gaming device. Benefits may have a redemption period that differs from the accumulation period, and may have expiration periods. Benefits may expire at different rates. Some of the benefits directly affect the paytable of the base machine.

16 Claims, 10 Drawing Sheets

(56) References Cited

U.S. PATENT DOCUMENTS 5,152,529 A 10/1992 Okada
5,178,395 A 1/1993 Lovell
5,221,083 A 6/1993 Dote
5,265,880 A 11/1993 Maksymec
5,342,049 A 8/1994 Wichinsky et al.
5,364,104 A 11/1994 Jones et al.
5,377,973 A 1/1995 Jones et al.
5,490,670 A 2/1996 Hobert
5,536,016 A 7/1996 Thompson
5,564,700 A 10/1996 Celona
5,584,485 A 12/1996 Jones et al.
5,586,766 A 12/1996 Forte et al.
5,655,961 A 8/1997 Acres et al.
5,674,128 A 10/1997 Holch et al.
5,695,402 A 12/1997 Stupak
5,697,844 A 12/1997 Von Kohorn
5,743,798 A 4/1998 Adams et al.
5,758,875 A 6/1998 Giacalone, Jr.
5,766,076 A 6/1998 Pease et al.
5,816,918 A 10/1998 Kelly et al.
5,830,064 A 11/1998 Bradish et al.
5,836,816 A 11/1998 Bruin et al.
5,836,817 A 11/1998 Acres et al.
5,851,147 A 12/1998 Stupak et al.
5,913,726 A 6/1999 Jones et al.
5,934,998 A 8/1999 Forte et al.
5,941,770 A 8/1999 Miers et al.
5,960,406 A 9/1999 Rasansky et al.
5,984,779 A 11/1999 Bridgeman et al.
6,012,983 A 1/2000 Walker et al.
6,024,642 A 2/2000 Stupak
6,030,109 A 2/2000 Lobsenz
6,032,955 A 3/2000 Luciano et al.
6,045,130 A 4/2000 Jones et al.
6,048,272 A 4/2000 Tsujita
6,059,659 A 5/2000 Busch et al.
6,077,163 A 6/2000 Walker et al.
6,086,477 A 7/2000 Walker et al.
6,106,395 A 8/2000 Begis
6,110,041 A 8/2000 Walker et al.
6,110,043 A 8/2000 Olsen
6,135,884 A 10/2000 Hedrick et al.
6,146,273 A 11/2000 Olsen
6,165,071 A 12/2000 Weiss
6,168,521 B1 1/2001 Luciano et al.
6,186,892 B1 2/2001 Frank et al.
6,186,893 B1 2/2001 Walker et al.
6,196,918 B1 3/2001 Miers et al.
6,217,448 B1 4/2001 Olsen
6,224,482 B1 5/2001 Bennett
6,234,900 B1 5/2001 Cumbers
6,254,483 B1 7/2001 Acres
6,264,560 B1 7/2001 Goldberg et al.
6,270,409 B1 8/2001 Shuster
6,289,382 B1 9/2001 Bowman-Amuah
6,293,866 B1 9/2001 Walker et al.
6,293,868 B1 9/2001 Bernard
6,302,793 B1 10/2001 Fertitta, III et al.
6,315,662 B1 11/2001 Jorasch et al.
6,315,666 B1 11/2001 Mastera et al.
6,319,122 B1 11/2001 Packes et al.
6,319,125 B1 11/2001 Acres
6,336,859 B2 1/2002 Jones et al.
6,347,996 B1 2/2002 Gilmore et al.
6,364,314 B1 4/2002 Canterbury
6,368,216 B1 4/2002 Hedrick
6,371,852 B1 4/2002 Acres
6,375,567 B1 4/2002 Acres
6,425,823 B1 7/2002 Byrne
6,428,002 B1 8/2002 Baranauskas
6,443,456 B1 9/2002 Gajor
6,454,648 B1 9/2002 Kelly et al.
6,457,045 B1 9/2002 Hanson et al.
6,471,588 B2 10/2002 Sakamoto
6,485,367 B1 11/2002 Joshi
6,485,368 B2 11/2002 Jones et al.
6,520,856 B1 2/2003 Walker et al.
6,565,434 B1 5/2003 Acres
6,565,436 B1 5/2003 Baerlocher
6,569,013 B1 5/2003 Taylor
6,575,832 B1 6/2003 Manfredi et al.
6,592,457 B1 7/2003 Frohm et al.
6,599,186 B1 7/2003 Walker et al.
6,606,615 B1 8/2003 Jennings et al.
6,620,046 B2 9/2003 Rowe
6,634,922 B1 10/2003 Driscoll et al.
6,648,757 B1 11/2003 Slomiany et al.
6,652,378 B2 11/2003 Cannon et al.
6,656,047 B1 12/2003 Tarantino et al.
6,695,700 B2 2/2004 Walker et al.
6,697,165 B2 2/2004 Wakai et al.
6,702,670 B2 3/2004 Jasper et al.
6,709,331 B2 3/2004 Berman
6,712,693 B1 3/2004 Hettinger
6,712,695 B2 3/2004 Mothwurf et al.
6,722,985 B2 4/2004 Criss-Puszkiewicz et al.
6,749,510 B2 6/2004 Giobbi
6,751,657 B1 6/2004 Zothner
6,755,420 B2 6/2004 Colton
6,758,754 B1 7/2004 Lavanchy et al.
6,760,595 B2 7/2004 Inselberg
6,780,104 B2 8/2004 Fox
6,786,824 B2 9/2004 Cannon
6,800,026 B2 10/2004 Cannon
6,800,027 B2 10/2004 Giobbi et al.
6,802,778 B1 10/2004 Lemay et al.
6,811,482 B2 11/2004 Letovsky
6,811,486 B1 11/2004 Luciano, Jr.
6,860,808 B2 * 3/2005 Levitan ..... 463/16
6,860,810 B2 3/2005 Cannon et al.
6,939,227 B2 9/2005 Jorasch et al.
6,944,509 B2 9/2005 Altmaier et al.
6,948,171 B2 9/2005 Dan et al.
6,965,868 B1 11/2005 Bednarek
6,973,665 B2 12/2005 Dudkiewicz et al.
RE38,982 E 2/2006 Forte et al.
6,997,380 B2 2/2006 Safaei et al.
6,998,806 B2 2/2006 Suzuki
7,037,195 B2 5/2006 Schneider et al.
7,056,210 B2 6/2006 Bansemer et al.
7,069,232 B1 6/2006 Fox et al.
7,090,579 B2 8/2006 Tarantino
7,094,149 B2 8/2006 Walker et al.
7,094,150 B2 8/2006 Ungaro et al.
7,103,560 B1 9/2006 Fox et al.
7,131,908 B2 11/2006 Baerlocher
7,144,322 B2 12/2006 Gomez et al.
7,169,052 B2 1/2007 Beaulieu et al.
7,175,521 B2 2/2007 McClintic
7,182,690 B2 2/2007 Giobbi et al.
7,184,965 B2 2/2007 Fox et al.
7,186,181 B2 3/2007 Rowe
7,192,346 B2 3/2007 Mathis
7,195,243 B2 3/2007 Kenny et al.
7,201,654 B1 4/2007 Jarvis et al.
7,251,805 B2 7/2007 Koo
7,338,372 B2 3/2008 Morrow et al.
7,361,089 B2 4/2008 Daly et al.
7,374,486 B2 5/2008 Baerlocher
7,416,186 B2 8/2008 Walker et al.
7,458,892 B2 12/2008 Walker et al.
7,594,851 B2 9/2009 Falconer
7,628,691 B2 12/2009 Luciano et al.
7,674,180 B2 3/2010 Graham et al.
7,775,876 B2 8/2010 Rowe
7,811,167 B2 10/2010 Giobbi et al.
7,846,018 B2 12/2010 Baerlocher
7,874,911 B2 1/2011 Walker et al.
7,963,844 B2 6/2011 Walker et al.
2001/0004609 A1 6/2001 Walker et al.
2001/0024015 A1 9/2001 Hogan et al.
2001/0046893 A1 11/2001 Giobbi et al.
2001/0048193 A1 12/2001 Yoseloff et al.
2002/0013173 A1 1/2002 Walker et al.

(56) References Cited

U.S. PATENT DOCUMENTS

2002/0016202 A1 2/2002 Fertitta et al.
2002/0019253 A1 2/2002 Reitzen et al.
2002/0032052 A1* 3/2002 Levitan ..... 463/29
2002/0034981 A1 3/2002 Hisada
2002/0039923 A1 4/2002 Cannon et al.
2002/0052229 A1* 5/2002 Halliburton ..... A63F 1/00 463/9
2002/0055381 A1 5/2002 Tarantino
2002/0086726 A1 7/2002 Ainsworth
2002/0090987 A1 7/2002 Walker et al.
2002/0094855 A1 7/2002 Berman
2002/0103018 A1 8/2002 Rommerdahl et al.
2002/0107072 A1 8/2002 Giobbi
2002/0123376 A1 9/2002 Walker et al.
2002/0132664 A1 9/2002 Miller et al.
2002/0142825 A1 10/2002 Lark et al.
2002/0143652 A1 10/2002 Beckett
2002/0147040 A1 10/2002 Walker et al.
2002/0147043 A1 10/2002 Shulman et al.
2002/0152120 A1 10/2002 Howington
2002/0177480 A1 11/2002 Rowe
2002/0177483 A1 11/2002 Cannon
2002/0187834 A1 12/2002 Rowe et al.
2002/0193162 A1 12/2002 Walker et al.
2003/0003989 A1 1/2003 Johnson
2003/0013512 A1 1/2003 Rowe
2003/0032474 A1 2/2003 Kaminkow
2003/0036425 A1 2/2003 Kaminkow et al.
2003/0054878 A1 3/2003 Benoy et al.
2003/0054881 A1 3/2003 Hedrick et al.
2003/0060276 A1 3/2003 Walker et al.
2003/0064769 A1 4/2003 Muir
2003/0064771 A1 4/2003 Morrow et al.
2003/0067116 A1 4/2003 Colton
2003/0078101 A1 4/2003 Schneider et al.
2003/0083943 A1* 5/2003 Adams et al. ..... 705/14
2003/0087685 A1 5/2003 Hogan et al.
2003/0092484 A1 5/2003 Schneider et al.
2003/0100360 A1* 5/2003 Manfredi et al. ..... 463/25
2003/0114217 A1 6/2003 Walker et al.
2003/0119575 A1 6/2003 Centuori et al.
2003/0135304 A1 7/2003 Sroub et al.
2003/0144048 A1 7/2003 Silva
2003/0157978 A1* 8/2003 Englman ..... G07F 17/3244 463/16
2003/0178774 A1 9/2003 Marcilio
2003/0186733 A1 10/2003 Wolf et al.
2003/0187736 A1 10/2003 Teague et al.
2003/0190944 A1 10/2003 Manfredi et al.
2003/0195029 A1 10/2003 Frohm et al.
2003/0199295 A1 10/2003 Vancura
2003/0199312 A1* 10/2003 Walker et al. ..... 463/25
2003/0204474 A1 10/2003 Capek et al.
2003/0207711 A1 11/2003 Rowe
2003/0209853 A1 11/2003 Harris
2003/0211884 A1 11/2003 Gauselmann
2003/0216169 A1* 11/2003 Walker et al. ..... 463/25
2003/0220138 A1 11/2003 Walker et al.
2003/0220139 A1 11/2003 Peterson
2003/0220143 A1 11/2003 Shteyn et al.
2003/0228901 A1* 12/2003 Walker et al. ..... 463/25
2003/0232640 A1 12/2003 Walker et al.
2003/0234489 A1 12/2003 Okada
2003/0236110 A1 12/2003 Beaulieu et al.
2004/0009808 A1 1/2004 Gauselmann
2004/0038735 A1 2/2004 Stell et al.
2004/0038736 A1* 2/2004 Bryant et al. ..... 463/29
2004/0048650 A1 3/2004 Mierau et al.
2004/0053657 A1 3/2004 Fiden et al.
2004/0053681 A1 3/2004 Jordan et al.
2004/0063484 A1 4/2004 Dreaper et al.
2004/0072609 A1 4/2004 Ungaro et al.
2004/0092315 A1 5/2004 Boyd et al.
2004/0103013 A1 5/2004 Jameson
2004/0121833 A1 6/2004 Mezen et al.
2004/0142742 A1 7/2004 Schneider et al.
2004/0166940 A1 8/2004 Rothschild
2004/0176157 A1* 9/2004 Walker ..... G07F 17/32 463/16
2004/0180722 A1 9/2004 Giobbi
2004/0198485 A1 10/2004 Loose et al.
2004/0203611 A1 10/2004 Laporta et al.
2004/0204213 A1 10/2004 Schugar et al.
2004/0204216 A1 10/2004 Schugar
2004/0204222 A1 10/2004 Roberts
2004/0219967 A1 11/2004 Giobbi et al.
2004/0224750 A1 11/2004 Al-Ziyoud
2004/0229671 A1 11/2004 Stronach et al.
2004/0229683 A1 11/2004 Mothwurf et al.
2004/0229700 A1 11/2004 Cannon et al.
2004/0235542 A1 11/2004 Stronach et al.
2004/0248642 A1 12/2004 Rothschild
2004/0254010 A1 12/2004 Fine
2005/0014558 A1 1/2005 Estey
2005/0026674 A1 2/2005 Wolf et al.
2005/0043072 A1 2/2005 Nelson
2005/0043088 A1 2/2005 Nguyen et al.
2005/0043092 A1 2/2005 Gauselmann
2005/0043094 A1 2/2005 Nguyen et al.
2005/0049028 A1* 3/2005 Gornez et al. ..... 463/20
2005/0054438 A1* 3/2005 Rothschild et al. ..... 463/29
2005/0059467 A1 3/2005 Saffari et al.
2005/0070356 A1 3/2005 Mothwurf et al.
2005/0075164 A1 4/2005 Krynicky
2005/0096121 A1* 5/2005 Gilliland et al. ..... 463/20
2005/0096124 A1 5/2005 Stronach
2005/0101375 A1 5/2005 Webb et al.
2005/0101379 A1 5/2005 Falconer
2005/0119052 A1 6/2005 Russell et al.
2005/0124411 A1 6/2005 Schneider et al.
2005/0124415 A1 6/2005 Centuori et al.
2005/0148380 A1 7/2005 Cannon et al.
2005/0148383 A1 7/2005 Mayeroff
2005/0153773 A1* 7/2005 Nguyen et al. ..... 463/25
2005/0164764 A1 7/2005 Ghaly
2005/0181856 A1 8/2005 Cannon et al.
2005/0181860 A1 8/2005 Nguyen et al.
2005/0181862 A1 8/2005 Ashter et al.
2005/0187014 A1 8/2005 Saffari et al.
2005/0208995 A1 9/2005 Marshall et al.
2005/0215311 A1 9/2005 Hornik et al.
2005/0215314 A1 9/2005 Schneider et al.
2005/0215316 A1 9/2005 Rowe et al.
2005/0233794 A1 10/2005 Cannon et al.
2005/0239541 A1 10/2005 Jorasch et al.
2005/0239545 A1 10/2005 Rowe
2005/0251440 A1 11/2005 Bednarek
2005/0255902 A1 11/2005 Lind
2005/0266905 A1 12/2005 Emori et al.
2006/0009284 A1 1/2006 Schwartz et al.
2006/0025205 A1 2/2006 Casey et al.
2006/0025207 A1 2/2006 Walker et al.
2006/0025210 A1 2/2006 Johnson
2006/0030400 A1 2/2006 Mathis
2006/0040723 A1 2/2006 Baerlocher et al.
2006/0040730 A1* 2/2006 Walker ..... G07F 17/3244 463/20
2006/0046830 A1 3/2006 Webb
2006/0046835 A1 3/2006 Walker et al.
2006/0052160 A1 3/2006 Saffari et al.
2006/0058095 A1 3/2006 Berman et al.
2006/0058097 A1 3/2006 Berman et al.
2006/0068898 A1* 3/2006 Maya ..... 463/25
2006/0068899 A1 3/2006 White et al.
2006/0068903 A1 3/2006 Walker et al.
2006/0073872 A1 4/2006 B-Jensen et al.
2006/0073887 A1 4/2006 Nguyen et al.
2006/0079310 A1 4/2006 Friedman et al.
2006/0079314 A1 4/2006 Walker et al.
2006/0084496 A1 4/2006 Jaffe et al.
2006/0094493 A1 5/2006 Kido
2006/0100009 A1 5/2006 Walker et al.
2006/0105836 A1 5/2006 Walker et al.
2006/0116201 A1 6/2006 Gauselmann

(56) References Cited

U.S. PATENT DOCUMENTS

2006/0121972 A1 6/2006 Walker et al.
2006/0128467 A1 6/2006 Thomas
2006/0135249 A1 6/2006 Seelig et al.
2006/0148559 A1* 7/2006 Jordan et al. ..... 463/29
2006/0149632 A1 7/2006 Register et al.
2006/0154714 A1 7/2006 Montross et al.
2006/0174270 A1 8/2006 Westberg et al.
2006/0183530 A1 8/2006 Ellis
2006/0183536 A1 8/2006 Gagner et al.
2006/0199631 A1 9/2006 McGill et al.
2006/0211486 A1 9/2006 Walker et al.
2006/0217175 A1 9/2006 Walker et al.
2006/0229127 A1 10/2006 Walker et al.
2006/0247041 A1 11/2006 Walker et al.
2006/0252510 A1 11/2006 Walker et al.
2006/0252512 A1 11/2006 Walker et al.
2006/0258422 A1 11/2006 Walker et al.
2006/0258425 A1 11/2006 Edidin et al.
2006/0258432 A1 11/2006 Packer et al.
2006/0287034 A1 12/2006 Englman et al.
2006/0287045 A1 12/2006 Walker et al.
2006/0287098 A1 12/2006 Morrow et al.
2006/0287102 A1 12/2006 White et al.
2007/0001396 A1 1/2007 Walker et al.
2007/0010309 A1 1/2007 Giobbi et al.
2007/0010315 A1 1/2007 Hein
2007/0050256 A1 3/2007 Walker et al.
2007/0060252 A1 3/2007 Taylor
2007/0060387 A1 3/2007 Enzminger et al.
2007/0105615 A1 5/2007 Lind
2007/0105618 A1 5/2007 Steil
2007/0106553 A1 5/2007 Jordan et al.
2007/0112609 A1 5/2007 Howard et al.
2007/0117619 A1 5/2007 Walker et al.
2007/0117623 A1 5/2007 Nelson et al.
2007/0129147 A1 6/2007 Gagner
2007/0135214 A1 6/2007 Walker et al.
2007/0143156 A1 6/2007 van Deursen
2007/0167210 A1 7/2007 Kelly et al.
2007/0191087 A1 8/2007 Thomas et al.
2007/0197247 A1 8/2007 Inselberg
2007/0205556 A1 9/2007 Roemer et al.
2007/0259709 A1 11/2007 Kelly et al.
2007/0275777 A1 11/2007 Walker et al.
2008/0015004 A1 1/2008 Gatto et al.
2008/0039190 A1 2/2008 Walker et al.
2008/0058105 A1 3/2008 Combs et al.
2008/0064495 A1* 3/2008 Bryant et al. ..... 463/29
2008/0076576 A1 3/2008 Graham et al.
2008/0102921 A1 5/2008 Urquhart
2008/0102935 A1 5/2008 Finnimore
2008/0113773 A1 5/2008 Johnson et al.
2008/0113811 A1 5/2008 Linard et al.
2008/0132320 A1 6/2008 Rodgers
2008/0146331 A1 6/2008 Nordman et al.
2008/0182655 A1 7/2008 DeWaal et al.
2008/0234035 A1 9/2008 Malek
2008/0242398 A1 10/2008 Harris et al.
2008/0248851 A1 10/2008 Bloom
2008/0254886 A1 10/2008 Kelly
2008/0268959 A1 10/2008 Bryson et al.
2008/0293467 A1 11/2008 Mathis
2008/0293473 A1* 11/2008 Fiden ..... G07F 17/32 463/16
2008/0318656 A1 12/2008 Walker et al.
2009/0005170 A9 1/2009 Kelly et al.
2009/0036202 A1 2/2009 Baerlocher et al.
2009/0088239 A1 4/2009 Iddings et al.
2009/0124364 A1 5/2009 Cuddy et al.
2009/0131175 A1 5/2009 Kelly et al.
2009/0176580 A1 7/2009 Herrmann et al.
2009/0239601 A1 9/2009 Macke
2009/0247284 A1 10/2009 Sugiyama et al.
2009/0253478 A1 10/2009 Walker et al.
2009/0270168 A1 10/2009 Englman et al.
2010/0016055 A1 1/2010 Englman
2010/0041464 A1 2/2010 Arezina et al.
2010/0056248 A1 3/2010 Acres
2010/0130276 A1* 5/2010 Fiden ..... G06Q 30/08 463/16
2011/0081958 A1 4/2011 Herrmann et al.
2011/0117987 A1* 5/2011 Aoki ..... G07F 17/32 463/20
2011/0124402 A1* 5/2011 De Waal ..... G07F 17/3244 463/25

FOREIGN PATENT DOCUMENTS

EP 0 896 308 Al 2/1999
EP 0 919 965 A2 6/1999
EP 0 981 397 Al 3/2000
EP 1 091 789 Al 4/2001
EP 1 231 577 A2 8/2002
EP 1 351 180 10/2003
EP 1 369 830 Al 12/2003
EP 1 490 849 A2 12/2004
EP 1 496 419 1/2005
EP 1 623 375 Al 2/2006
EP 1 637 196 Al 3/2006
EP 1 832 952 9/2007
JP 2-21883 1/1990
WO WO 95/21665 8/1995
WO WO 95/31262 11/1995
WO WO 96/35490 11/1996
WO WO 97/46293 12/1997
WO WO 00/17825 3/2000
WO WO 00/32286 6/2000
WO WO 00/64545 11/2000
WO WO 01/36059 A1 5/2001
WO WO 01/59680 8/2001
WO WO 01/80961 A1 11/2001
WO WO 03/066179 A2 8/2003
WO WO 03/089092 10/2003
WO WO 2005/029279 A2 3/2005
WO WO 2005/029287 A2 3/2005
WO WO 2005/099845 A1 10/2005
WO WO 2005/113093 A1 12/2005
WO WO 2006/014745 2/2006
WO WO 2006/014770 A2 2/2006
WO WO 2006/014990 A2 2/2006
WO WO 2006/032498 A1 3/2006
WO WO 2006/036948 A2 4/2006
WO WO 2006/055518 A2 5/2006
WO WO 2006/060442 6/2006
WO WO 2006/060493 6/2006
WO WO 2007-087286 8/2007
WO WO 2008/024705 A2 2/2008

OTHER PUBLICATIONS

Acres, John, An ingenious Internet Marketing Tool, Slot Operations Management / Casino Enterprise Management, Aug. 2007, pp. 8-10.

* cited by examiner

PLAYER-BASED COMPENSATION

RELATED APPLICATIONS

This application claims priority to U.S. Provisional Patent application No. 60/987,293, filed Nov. 12, 2007, entitled USING A PLAYER TRACKING SYSTEM TO IMPLEMENT A BONUS AWARD FOR A PLAYER OF AN ELECTRONIC GAMING MACHINE, the contents of which are hereby incorporated by reference. Additionally this application is related to U.S. patent application Ser. No. 12/166,150, entitled PLAYER VALUE DETERMINATION SYSTEM, and to U.S. patent application Ser. No. 12/166,049, entitled GAMING DEVICE CONFIGURATION BASED ON PLAYER VALUE, both of which were filed on Jul. 1, 2008, and the teachings of both of which are incorporated by reference.

TECHNICAL FIELD

The present invention relates to gaming systems, and, more particularly, to a system for configuring a gaming device based on the value or potential value of an identified player.

BACKGROUND

Gaming is an industry heavily regulated by federal, state, and local government. Gaming regulators ensure table rules and slot machines are calibrated or programmed to provide a reasonable rate of return to their players. Typically, for slot machines, gaming regulators set a minimum and sometimes a maximum rate of return. These "return rates", which are the counterpart to casino "hold percentages," are set to provide the specified rate of return to players over a relatively large number of games, or "pulls." In other words, if a game is configured for a return rate of 95%, the game should approximate that return rate over a period of play. Of course, the game's volatility could cause it to pay far above or below its configured return rate over short periods, but the game should approach its configured return rate as the period of play increases.

In most jurisdictions, gaming regulators will specify a minimum return rate—say 75%. Of course, a gaming machine that pays back more than it takes in—which by definition it does if the return rate is >100%—it cannot be profitable for the casino. Some casinos will configure a few of their games at >100% payback as a marketing ploy but generally a game's return rate is set somewhere above the regulated minimum return rate and an upper amount of <100%.

The "volatility" of a game refers to how often and how much a game pays. A game may achieve, for example a 0.85 return rate by paying relatively low wins fairly often (low volatility), or by paying relatively large wins fairly infrequently (high volatility). In both cases the average payout of the game equals the specified 0.85 return rate, but how that rate is paid out differs significantly. Some players prefer low volatile games, while others prefer higher volatility.

Casinos typically set the return rates somewhere between the minimum and to achieve maximum profit. Return rates set near the minimum make the most money per game played, but fewer people will choose to gamble because losses are so frequent. Higher return rates almost certainly instigate additional play but too high a return rate will decrease profits even more than increased volume can compensate for.

Changing the hold percentages and volatility of games typically requires the casino operator to physically change a computer chip on the game, although newer technology allows "electronic downloading of a different hold percentage or volatility characteristic. Regardless of how configured, the volatility and payback characteristics of a game are held constant, regardless of individual player desire or worth. Casinos have long recognized that some players are worth more than others and that some players prefer different volatility characteristics than others.

Bonuses are paid above and beyond the pay table of the base game. Bonuses, such as cash bonuses or other credits are used to reward repeat customers and encourage them to frequent a particular casino. Bonuses are often awarded through a system that tracks a player's play, known as "player tracking" systems. After the player has played a minimum number of hands, or satisfies other criteria, the casino awards the player a bonus in some form. Such bonuses allow the casino to offer certain players a higher overall payback for a given wager amount but bonuses cannot significantly impact the volatility of the game itself.

Some players do not like to use player tracking cards because they feel that the casino will "punish" them if they receive a big win on the underlying base game, and not pay another win for a relatively long time. These concerns exist even though player tracking systems only add to the winnings of the underlying base game, and do not take away from it. Such distrust causes many players to play without a card inserted, even if playing with such a card ultimately benefits the player.

Casinos would like to entice players to use cards while gaming so that the casinos can provide a more customized entertainment experience for each player, but the distrust prevents many players from using the player tracking cards.

Embodiments of the invention address these and other issues in the prior art.

DESCRIPTION

Figure 1A:
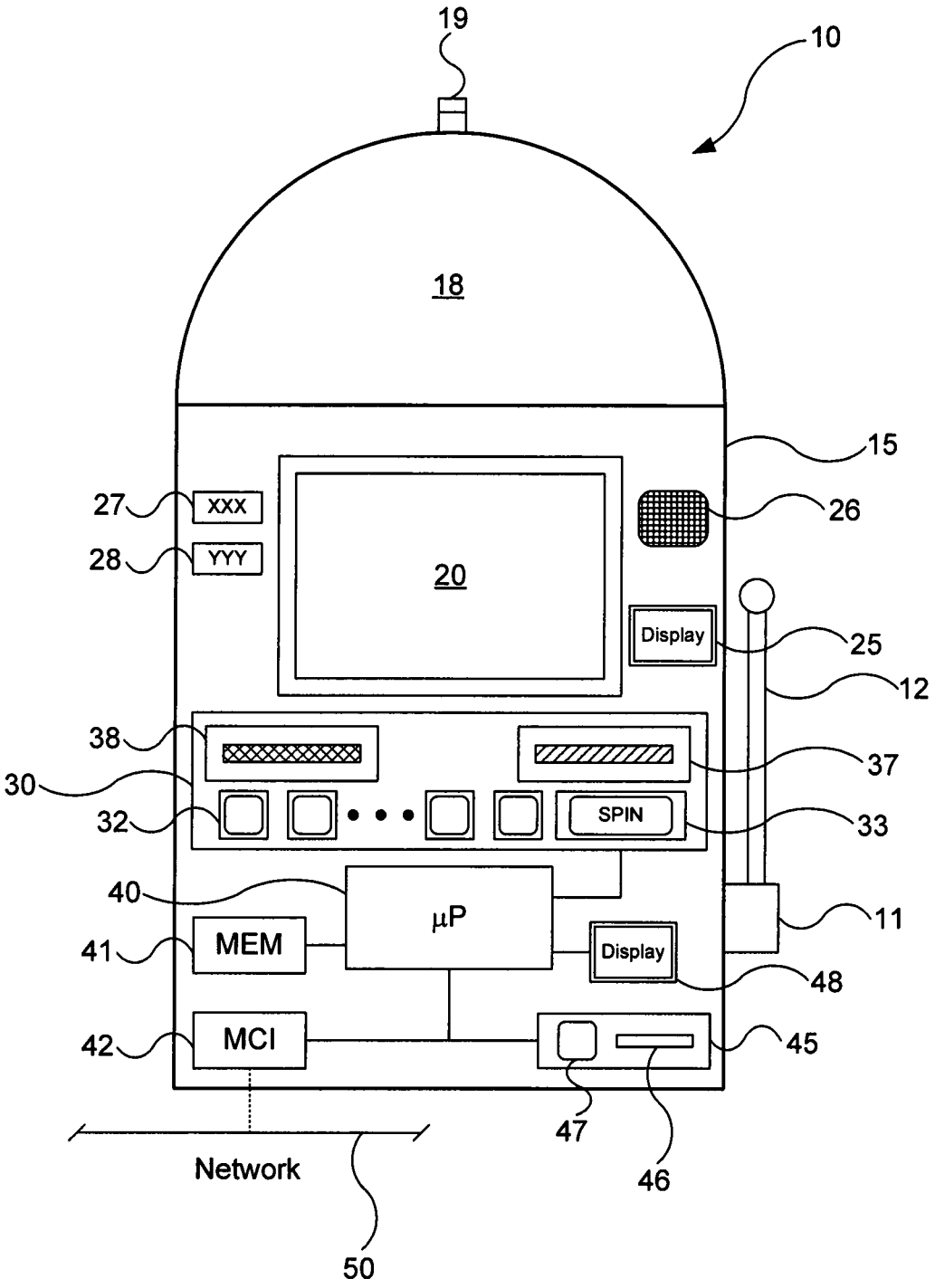
FIG. 1A is a functional block diagram that illustrates a gaming device according to embodiments of the invention.
Figure 1B:
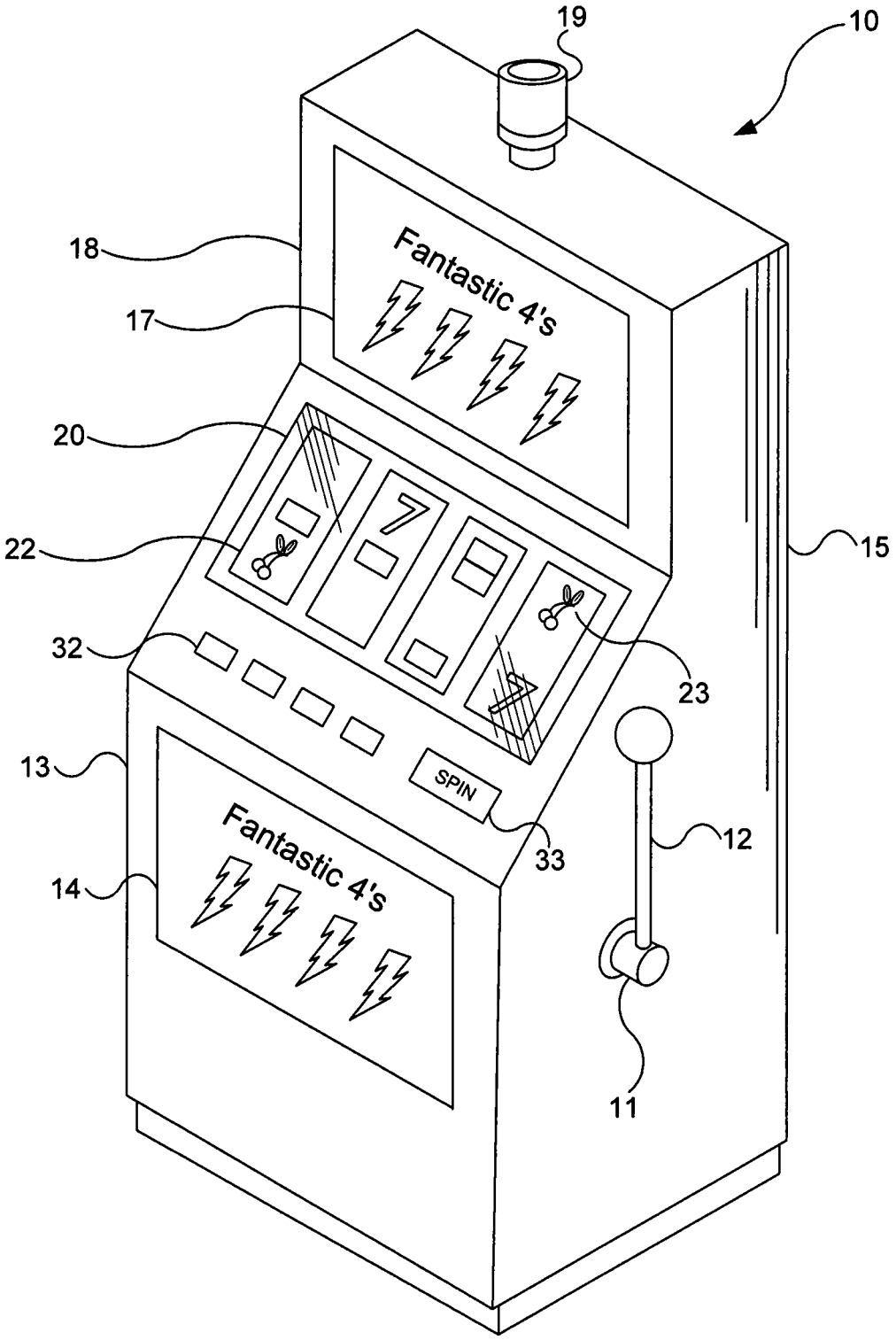
FIG. 1B is an isometric view of the gaming device illustrated in FIG. 1A.

FIGS. 1A and 1B illustrate example gaming devices according to embodiments of the invention.

Referring to FIGS. 1A and 1B, a gaming device 10 is an electronic gaming machine. Although an electronic gaming machine or "slot" machine is illustrated, various other types of devices may be used to wager monetarily based credits on a game of chance in accordance with principles of the invention. The term "electronic gaming device" is meant to include various devices such as electro-mechanical spinning-reel type slot machines, video slot machines, and video poker machines, for instance. Other gaming devices may include computer-based gaming machines, wireless gaming devices, multi-player gaming stations, modified personal electronic gaming devices (such as cell phones), personal computers, server-based gaming terminals, and other similar devices. Although embodiments of the invention will work with all of the gaming types mentioned, for ease of illustration the present embodiments will be described in reference to the electronic gaming machine 10 shown in FIGS. 1A and 1B.

The gaming device 10 includes a cabinet 15 housing components to operate the gaming device 10. The cabinet 15 may include a gaming display 20, a base portion 13, a top box 18, and a player interface panel 30. The gaming display 20 may include mechanical spinning reels (FIG. 2A), a video display (FIGS. 2B and 2C), or a combination of both spinning reels and a video display (not shown). The gaming cabinet 15 may also include a credit meter 27 and a coin-in or bet meter 28. The credit meter 27 may indicate the total number of credits remaining on the gaming device 10 that are eligible to be wagered. In some embodiments, the credit meter 27 may reflect a monetary unit, such as dollars. However, it is often preferable to have the credit meter 27 reflect a number of 'credits,' rather than a monetary unit. The bet meter 28 may indicate the amount of credits to be wagered on a particular game. Thus, for each game, the player transfers the amount that he or she wants to wager from the credit meter 27 to the bet meter 28. In some embodiments, various other meters may be present, such as meters reflecting amounts won, amounts paid, or the like. In embodiments where the gaming display 20 is a video monitor, the information indicated on the credit meters may be shown on the gaming display itself 20 (FIG. 2B).

The base portion 13 may include a lighted panel 14, a coin return (not shown), and a gaming handle 12 operable on a partially rotating pivot joint 11. The game handle 12 is traditionally included on mechanical spinning-reel games, where the handle may be pulled toward a player to initiate the spinning of reels 22 after placement of a wager. The top box 18 may include a lighted panel 17, a video display (such as an LCD monitor), a mechanical bonus device (not shown), and a candle light indicator 19. The player interface panel 30 may include various devices so that a player can interact with the gaming device 10.

The player interface panel 30 may include one or more game buttons 32 that can be actuated by the player to cause the gaming device 10 to perform a specific action. For example, some of the game buttons 32 may cause the gaming device 10 to bet a credit to be wagered during the next game, change the number of lines being played on a multi-line game, cash out the credits remaining on the gaming device (as indicated on the credit meter 27), or request assistance from casino personnel, such as by lighting the candle 19. In addition, the player interface panel 30 may include one or more game actuating buttons 33. The game actuating buttons 33 may initiate a game with a pre-specified amount of credits. On some gaming devices 10 a "Max Bet" game actuating button 33 may be included that places the maximum credit wager on a game and initiates the game. The player interface panel 30 may further include a bill acceptor 37 and a ticket printer 38. The bill acceptor 37 may accept and validate paper money or previously printed tickets with a credit balance. The ticket printer 38 may print out tickets reflecting the balance of the credits that remain on the gaming device 10 when a player cashes out by pressing one of the game buttons 32 programmed to cause a 'cash-out.' These tickets may be inserted into other gaming machines or redeemed at a cashier station or kiosk for cash.

The gaming device 10 may also include one or more speakers 26 to transmit auditory information or sounds to the player. The auditory information may include specific sounds associated with particular events that occur during game play on the gaming device 10. For example, a particularly festive sound may be played during a large win or when a bonus is triggered. The speakers 26 may also transmit "attract" sounds to entice nearby players when the game is not currently being played.

The gaming device 10 may further include a secondary display 25. This secondary display 25 may be a vacuum fluorescent display (VFD), a liquid crystal display (LCD), a cathode ray tube (CRT), a plasma screen, or the like. The secondary display 25 may show ancillary information to the player. For example, the secondary display 25 may show player tracking information, secondary bonus information, advertisements, or player selectable game options.

The gaming device 10 includes a microprocessor 40 that controls operation of the gaming device 10. If the gaming device 10 is a standalone gaming device, the microprocessor 40 may control virtually all of the operations of the gaming devices and attached equipment, such as operating game logic stored in memory (not shown) as firmware, controlling the display 20 to represent the outcome of a game, communicating with the other peripheral devices (such as the bill acceptor 37), and orchestrating the lighting and sound emanating from the gaming device 10. In other embodiments where the gaming device 10 is coupled to a network 50, as described below, the microprocessor 40 may have different tasks depending on the setup and function of the gaming device. For example, the microprocessor 40 may be responsible for running the base game of the gaming device and executing instructions received over the network 50 from a bonus server or player tracking server. In a server-based gaming setup, the microprocessor 40 may act as a terminal to execute instructions from a remote server that is running game play on the gaming device.

The microprocessor 40 may be coupled to a machine communication interface (MCI) 42 that connects the gaming device 10 to a gaming network 50. The MCI 42 may be coupled to the microprocessor 40 through a serial connection, a parallel connection, an optical connection, or in some cases a wireless connection. The gaming device 10 may include memory 41 (MEM), such as a random access memory (RAM), coupled to the microprocessor 40 and which can be used to store gaming information, such as storing total coin-in statistics about a present or past gaming session, which can be communicated to a remote server or database through the MCI 42. The MCI 42 may also facilitate communication between the network 50 and the secondary display 25 or a player tracking unit 45 housed in the gaming cabinet 15.

The player tracking unit 45 may include an identification device 46 and one or more buttons 47 associated with the player tracking unit 45. The identification device 46 serves to identify a player, by, for example, reading a player-tracking device, such as a player tracking card that is issued by the casino to individual players who choose to have such a card. The identification device 46 may instead, or additionally, identify players through other methods, such as user ID and PIN or password, biometric methods such as a fingerprint, hand or eye scanner, or a receiver to receive a unique signal from the player, such as an RFID signal used to uniquely identify the player. Player tracking systems using player tracking cards and card readers 46 are known in the art. Briefly summarizing such a system, a player registers with the casino prior to commencing gaming. The casino issues a unique player-tracking card to the player and opens a corresponding player account that is stored on a server or host computer, described below with reference to FIG. 3. The player account may include the player's name and mailing address and other information of interest to the casino in connection with marketing efforts. Prior to playing one of the gaming devices in the casino, the player inserts the player tracking card into the identification device 46 thus permitting the casino to track player activity, such as amounts wagered, credits won, and rate of play.

A player tracking display screen 48 may be used to provide information about the player tracking system to the identified or unidentified player. For an identified player, the display screen 48 may display identification information, such as name or nickname, as well as the current "status" or indication of how many player points the identified player has accrued. It may also display various menu options for the player to manage the player account, such as redemptions. For an unidentified player, the display screen 48 may provide information on the benefits of signing up for a player account and being an identified member. For example, the display screen 48 may illustrate a particular offer to the player, such as "sign up now for a player account and receive 50 free credits—press 'here' now."

To induce the player to use the card and be an identified player, the casino may award each player points proportional to the money or credits wagered by the player. Players typically accrue points at a rate related to the amount wagered, although other factors may cause the casino to award the player various amounts. The points may be displayed on the secondary display 25 or using other methods. In conventional player tracking systems, the player may take his or her card to a special desk in the casino where a casino employee scans the card to determine how many accrued points are in the player's account. The player may redeem points for selected merchandise, meals in casino restaurants, or the like, which each have assigned point values. In some player tracking systems, the player may use the secondary display 25 to access their player tracking account, such as to check a total number of points, redeem points for various services, make changes to their account, or download promotional credits to the gaming device 10. In other embodiments, the identification device 46 may read other identifying cards (such as driver licenses, credit cards, etc.) to identify a player and match them to a corresponding player tracking account. Although FIG. 1A shows the player tracking unit 45 with a card reader as the identification device 46, other embodiments may include a player tracking unit 45 with a biometric scanner, PIN code acceptor, or other methods of identifying a player to pair the player with their player tracking account.

During typical play on a gaming device 10, a player plays a game by placing a wager and then initiating a gaming session. The player may initially insert monetary bills or previously printed tickets with a credit value into the bill acceptor 37. The player may also put coins into a coin acceptor (not shown) or a credit card into a card reader/authorizer (not shown). The credit meter 27 displays the numeric credit value of the money inserted dependent on the denomination of the gaming device 10. That is, if the gaming device 10 is a nickel slot machine and a $20 bill inserted into the bill acceptor 37, the credit meter will reflect 400 credits or one credit for each nickel of the inserted twenty dollars. For gaming devices 10 that support multiple denominations, the credit meter 27 will reflect the amount of credits relative to the denomination selected. Thus, in the above example, if a penny denomination is selected after the $20 is inserted the credit meter will change from 400 credits to 2000 credits.

A wager may be placed by pushing one or more of the game buttons 32, which may be reflected on the bet meter 28. That is, the player can generally depress a "bet one" button (one of the buttons on the player interface panel 30, such as 32), which transfers one credit from the credit meter 27 to the bet meter 28. Each time the button 32 is depressed an additional single credit transfers to the bet meter 28 up to a maximum bet that can be placed on a single play of the electronic gaming device 10. The gaming session may be initiated by pulling the gaming handle 12 or depressing the spin button 33. On some gaming devices 10, a "max bet" button (another one of the buttons 32 on the player interface panel 30) may be depressed to wager the maximum number of credits supported by the gaming device 10 and initiate a gaming session.

If the gaming session does not result in any winning combination, the process of placing a wager may be repeated by the player. Alternatively, the player may cash out any remaining credits on the credit meter 27 by depressing the "cash-out" button (another button 32 on the player interface panel 30), which causes the credits on the credit meter 27 to be paid out in the form of a ticket through the ticket printer 38, or may be paid out in the form of returning coins from a coin hopper (not shown) to a coin return tray.

If instead a winning combination (win) appears on the display 20, the award corresponding to the winning combination is immediately applied to the credit meter 27. For example, if the gaming device 10 is a slot machine, a winning combination of symbols 23 may land on a played payline on reels 22. If any bonus games are initiated, the gaming device 10 may enter into a bonus mode or simply award the player with a bonus amount of credits that are applied to the credit meter 27.

Figure 2A:
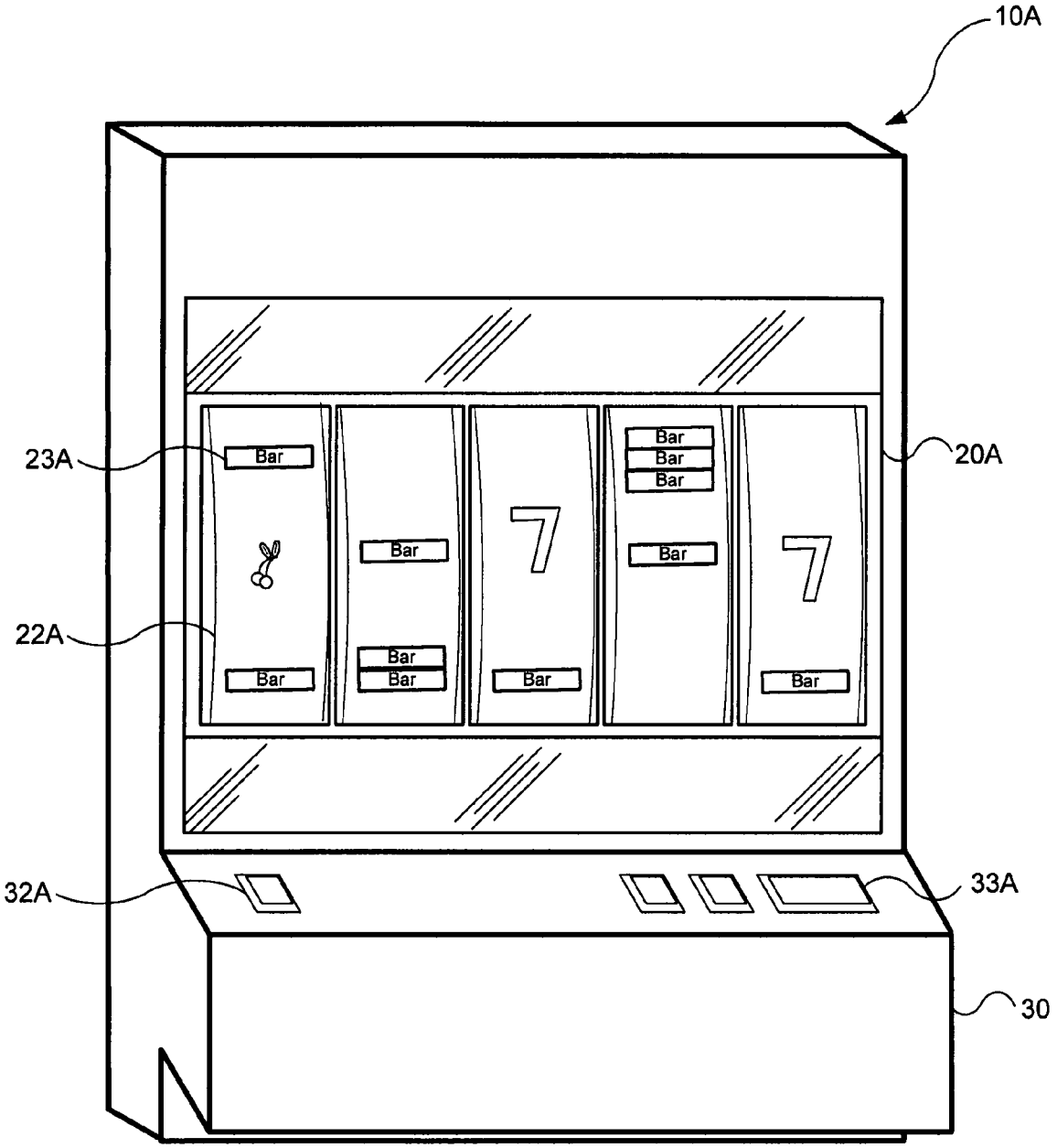
FIGS. 2A, 2B, and 2C are detail diagrams of exemplary types of gaming devices according to embodiments of the invention.
Figure 2B:
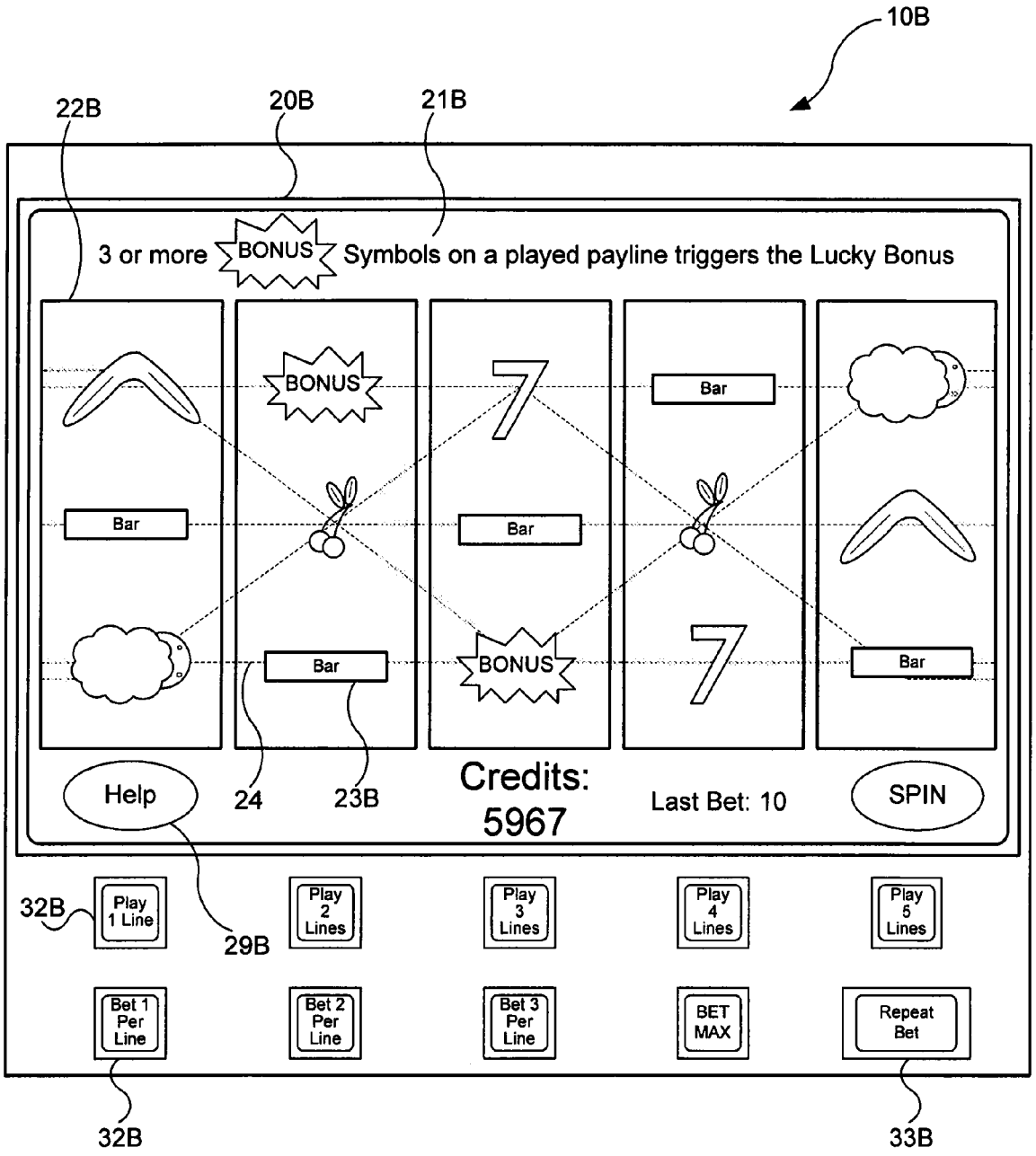
Figure 2C:
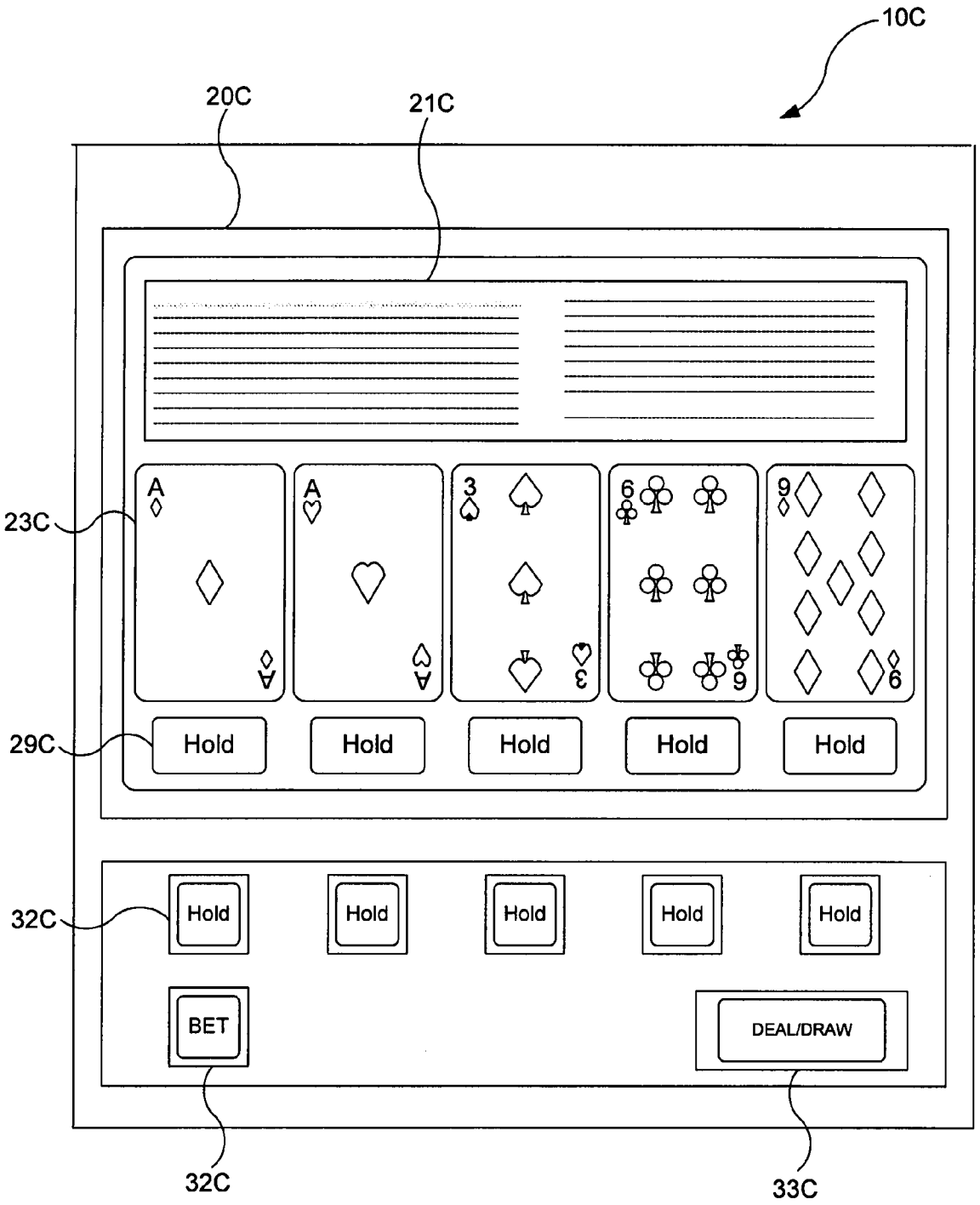

FIGS. 2A to 2C illustrate exemplary types of gaming devices according to embodiments of the invention. FIG. 2A illustrates an example spinning-reel gaming machine 10A, FIG. 2B illustrates an example video slot machine 10B, and FIG. 2C illustrates an example video poker machine 10C.

Referring to FIG. 2A, a spinning-reel gaming machine 10A includes a gaming display 20A having a plurality of mechanical spinning reels 22A. Typically, spinning-reel gaming machines 10A have three to five spinning reels 22A. Each of the spinning reels 22A has multiple symbols 23A that may be separated by blank areas on the spinning reels 22A, although the presence of blank areas typically depends on the number of reels 22A present in the gaming device 10A and the number of different symbols 23A that may appear on the spinning reels 22A. Each of the symbols 22A or blank areas makes up a "stop" on the spinning reel 22A where the reel 22A comes to rest after a spin. Although the spinning reels 22A of various games 10A may have various numbers of stops, many conventional spinning-reel gaming devices 10A have reels 22A with twenty two stops.

During game play, the spinning reels 22A may be controlled by stepper motors (not shown) under the direction of the microprocessor 40 (FIG. 1A). Thus, although the spinning-reel gaming device 10A has mechanical based spinning reels 22A, the movement of the reels themselves is electronically controlled to spin and stop. This electronic control is advantageous because it allows a virtual reel strip to be stored in the memory 41 of the gaming device 10A, where various "virtual stops" are mapped to each physical stop on the physical reel 22A. This mapping allows the gaming device 10A to establish greater awards and bonuses available to the player because of the increased number of possible combinations afforded by the virtual reel strips.

A gaming session on a spinning reel slot machine 10A typically includes the player pressing the "bet-one" button (one of the game buttons 32A) to wager a desired number of credits followed by pulling the gaming handle 12 (FIGS. 1A, 1B) or pressing the spin button 33A to spin the reels 22A. Alternatively, the player may simply press the "max-bet" button (another one of the game buttons 32A) to both wager the maximum number of credits permitted and initiate the spinning of the reels 22A. The spinning reels 22A may all stop at the same time or may individually stop one after another (typically from left to right) to build player anticipation. Because the display 20A usually cannot be physically modified, some spinning reel slot machines 10A include an electronic display screen in the top box 18 (FIG. 1B), a mechanical bonus mechanism in the top box 18, or a secondary display 25 (FIG. 1A) to execute a bonus.

Referring to FIG. 2B, a video gaming machine 10B may include a video display 20B to display virtual spinning reels 22B and various other gaming information 21B. The video display 20B may be a CRT, LCD, plasma screen, or the like. It is usually preferable that the video display 20B be a touchscreen to accept player input. A number of symbols 23A appear on each of the virtual spinning reels 22B. Although FIG. 2B shows five virtual spinning reels 22B, the flexibility of the video display 20B allows for various reel 22B and game configurations. For example, some video slot games 10B spin reels for each individual symbol position (or stop) that appears on the video display 20B. That is, each symbol position on the screen is independent of every other position during the gaming sessions. In these types of games, very large numbers of pay lines or multiple super scatter pays can be utilized since similar symbols could appear at every symbol position on the video display 20B. On the other hand, other video slot games 10B more closely resemble the mechanical spinning reel games where symbols that are vertically adjacent to each other are part of the same continuous virtual spinning reel 22B.

Because the virtual spinning reels 22B, by virtue of being computer implemented, can have almost any number of stops on a reel strip, it is much easier to have a greater variety of displayed outcomes as compared to spinning-reel slot machines 10A (FIG. 2A) that have a fixed number of physical stops on each spinning reel 22A.

With the possible increases in reel 22B numbers and configurations over the mechanical gaming device 10A, video gaming devices 10B often have multiple paylines 24 that may be played. By having more paylines 24 available to play, the player may be more likely to have a winning combination when the reels 22B stop and the gaming session ends. However, since the player typically must wager at least a minimum number of credits to enable each payline 24 to be eligible for winning, the overall odds of winning are not much different, if at all, than if the player is wagering only on a single payline. For example, in a five line game, the player may bet one credit per payline 24 and be eligible for winning symbol combinations that appear on any of the five played paylines 24. This gives a total of five credits wagered and five possible winning paylines 24. If, on the other hand, the player only wagers one credit on one payline 24, but plays five gaming sessions, the odds of winning would be identical as above: five credits wagered and five possible winning paylines 24.

Because the video display 20B can easily modify the image output by the video display 20B, bonuses, such as second screen bonuses are relatively easy to award on the video slot game 10B. That is, if a bonus is triggered during game play, the video display 20B may simply store the resulting screen shot in memory and display a bonus sequence on the video display 20B. After the bonus sequence is completed, the video display 20B may then retrieve the previous screen shot and information from memory, and re-display that image.

Also, as mentioned above, the video display 20B may allow various other game information 21B to be displayed. For example, as shown in FIG. 2B, banner information may be displayed above the spinning reels 22B to inform the player, perhaps, which symbol combination is needed to trigger a bonus. Also, instead of providing a separate credit meter 27 (FIG. 1A) and bet meter 28, the same information can instead be displayed on the video display 20B. In addition, "soft buttons" 29B such as a "spin" button or "help/see pays" button may be built using the touch screen video display 20B. Such customization and ease of changing the image shown on the display 20B adds to the flexibility of the game 10B.

Even with the improved flexibility afforded by the video display 20B, several physical buttons 32B and 33B are usually provided on video slot machines 10B. These buttons may include game buttons 32B that allow a player to choose the number of paylines 24 he or she would like to play and the number of credits wagered on each payline 24. In addition, a max bet button (one of the game buttons 32B) allows a player to place a maximum credit wager on the maximum number of available paylines 24 and initiate a gaming session. A repeat bet or spin button 33B may also be used to initiate each gaming session when the max bet button is not used.

Referring to FIG. 2C, a video poker gaming device 10C may include a video display 20C that is physically similar to the video display 20B shown in FIG. 2B. The video display 20C may show a poker hand of five cards 23C and various other player information 21C including a paytable for various winning hands, as well as a plurality of player selectable soft buttons 29C. The video display 20C may present a poker hand of five cards 23C and various other player information 21C including a number of player selectable soft (touchscreen) buttons 29C and a paytable for various winning hands. Although the embodiment illustrated in FIG. 3C shows only one hand of poker on the video display 20C, various other video poker machines 10C may show several poker hands (multi-hand poker). Typically, video poker machines 10C play "draw" poker in which a player is dealt a hand of five cards, has the opportunity to hold any combination of those five cards, and then draws new cards to replace the discarded ones. All pays are usually given for winning combinations resulting from the final hand, although some video poker games 10C may give bonus credits for certain combinations received on the first hand before the draw. In the example shown in FIG. 2C a player has been dealt two aces, a three, a six, and a nine. The video poker game 10C may provide a bonus or payout for the player having been dealt the pair of aces, even before the player decides what to discard in the draw. Since pairs, three of a kind, etc. are typically needed for wins, a player would likely hold the two aces that have been dealt and draw three cards to replace the three, six, and nine in the hope of receiving additional aces or other cards leading to a winning combination with a higher award amount. After the draw and revealing of the final hand, the video poker game 10C typically awards any credits won to the credit meter.

The player selectable soft buttons 29C appearing on the screen respectively correspond to each card on the video display 20C. These soft buttons 29C allow players to select specific cards on the video display 20C such that the card corresponding to the selected soft button is "held" before the draw. Typically, video poker machines 10C also include physical game buttons 32C that correspond to the cards in the hand and may be selected to hold a corresponding card. A deal/draw button 33C may also be included to initiate a gaming session after credits have been wagered (with a bet button 32C, for example) and to draw any cards not held after the first hand is displayed.

Although examples of a spinning reel slot machine 10A, a video slot machine 10B, and a video poker machine 10C have been illustrated in FIGS. 2A-2C, gaming machines and various other types of gaming devices known in the art are contemplated and are within the scope of the invention.

Figure 3:
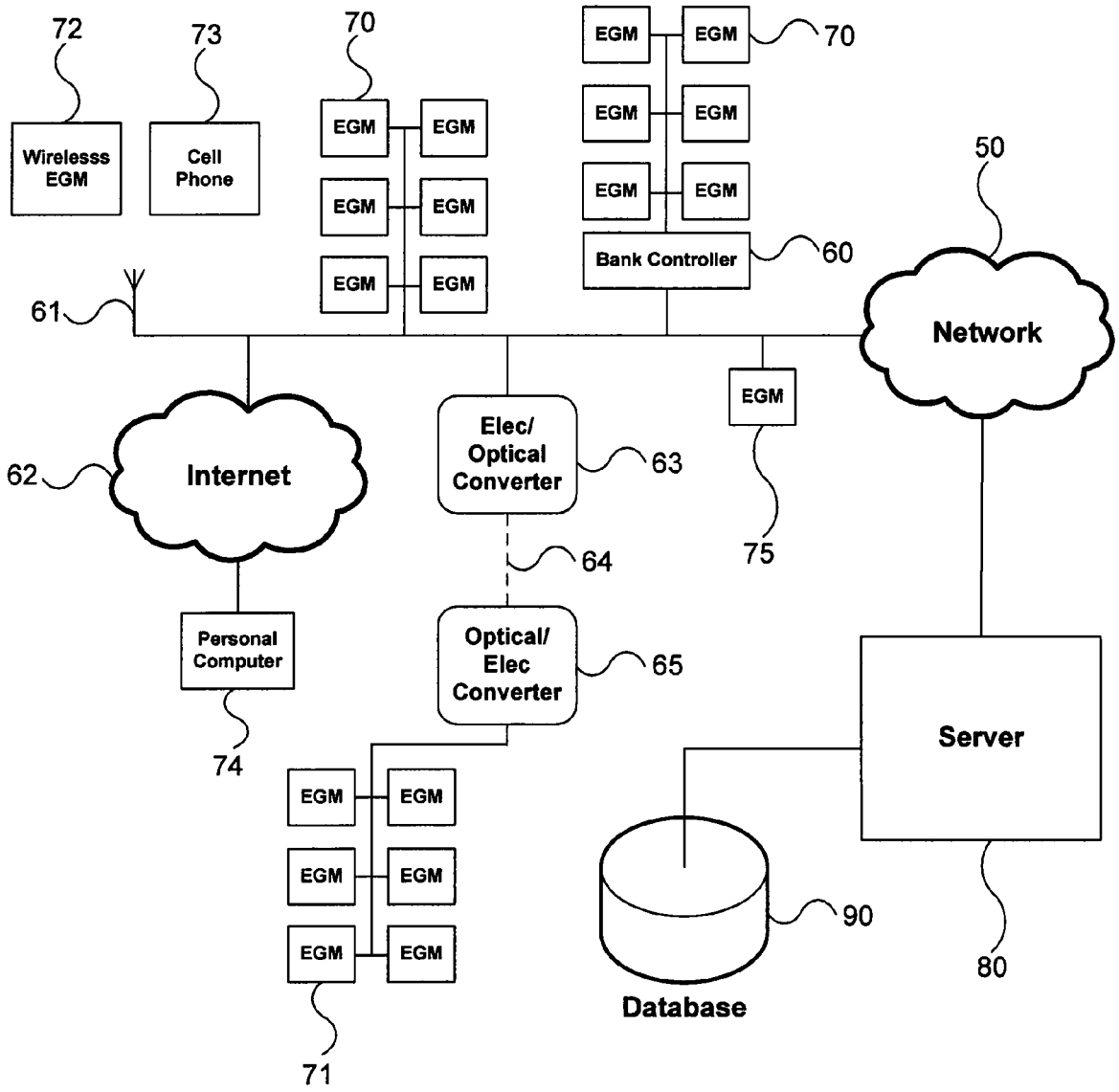
FIG. 3 is a functional block diagram of networked gaming devices according to embodiments of the invention.

FIG. 3 is a block diagram illustrating networked gaming devices according to embodiments of the invention. Referring to FIG. 3, multiple electronic gaming devices (EGMs) 70, 71, 72, 73, 74, and 75 may be coupled to one another and coupled to a remote server 80 through a network 50. For ease of understanding, gaming devices or EGMs 70, 71, 72, 73, 74, and 75 are generically referred to as EGMs 70-75. The term EGMs 70-75, however, may refer to any combination of one or more of EGMs 70, 71, 72, 73, 74, and 75. Additionally, the gaming server 80 may be coupled to one or more gaming databases 90. These gaming network 50 connections may allow multiple gaming devices 70-75 to remain in communication with one another during particular gaming modes such as tournament play or remote head-to-head play. Although some of the gaming devices 70-75 coupled on the gaming network 50 may resemble the gaming devices 10, 10A, 10B, and 10C shown in FIGS. 1A-1B and 2A-2C, other coupled gaming devices 70-75 may include differently configured gaming devices. For example, the gaming devices 70-75 may include traditional slot machines 75 directly coupled to the network 50, banks of gaming devices 70 coupled to the network 50, banks of gaming devices 70 coupled to the network through a bank controller 60, wireless handheld gaming machines 72 and cell phones 73 coupled to the gaming network 50 through one or more wireless routers or antennas 61, personal computers 74 coupled to the network 50 through the internet 62, and banks of gaming devices 71 coupled to the network through one or more optical connection lines 64. Additionally, some of the traditional gaming devices 70, 71, and 75 may include electronic gaming tables, multi-station gaming devices, or electronic components operating in conjunction with non-gaming components, such as automatic card readers, chip readers, and chip counters, for example.

Gaming devices 71 coupled over an optical line 64 may be remote gaming devices in a different location or casino. The optical line 64 may be coupled to the gaming network 50 through an electronic to optical signal converter 63 and may be coupled to the gaming devices 71 through an optical to electronic signal converter 65. The banks of gaming devices 70 coupled to the network 50 may be coupled through a bank controller 60 for compatibility purposes, for local organization and control, or for signal buffering purposes.

The EGMs 70-75 may include interface hardware (not separately illustrated) specifically to couple the EGMs to the server 80 through the gaming network 50, the interface hardware. The interface hardware may operate in conjunction with the EGM 70-75 to implement particular network functions or commands from the server 80. In other embodiments, the EGMs 70-75 include any interface HW within the EGMs themselves, without any separate interface hardware.

Commands, methods and processes, etc., can be performed by the server 80, other hardware connected to the network 50, the EGMs 70-75, the interface hardware described above, or the EGMs 70-75 themselves, depending on the implementation specifics as is known in the art. Where such functions originate or occur is immaterial to the implementations of the functions.

The network 50 may include serial or parallel signal transmission lines and carry data in accordance with data transfer protocols such as Ethernet transmission lines, firewire lines, USB lines, or other communication protocols. Although not shown in FIG. 3, substantially the entire network 50 may be made of optical lines 64 or may be a wireless network.

As mentioned above, each gaming device 70-75 may have an individual processor 40 (FIG. 1A) and memory 41 to run and control game play on the gaming device 70-75, or some of the gaming devices 70-75 may be terminals that are run by a remote server 80 in a server based gaming environment. Server based gaming environments may be advantageous to casinos by allowing fast downloading of particular game types or themes based on casino preference or player selection. Additionally, tournament based games, linked games, and certain game types, such as BINGO or keno may benefit from at least some server 80 based control.

Thus, in some embodiments, the network 50, server 80, and database 90 may be dedicated to communications regarding specific game or tournament play. In other embodiments, however, the network 50, server 80, and database 90 may be part of a player tracking network. For player tracking capabilities, when a player inserts a player tracking card in the card reader 46 (FIG. 1A), the player tracking unit 45 sends player identification information obtained on the card reader 46 through the MCI 42 over the network 50 to the player tracking server 80, where the player identification information is compared to player information records in the player database 90 to provide the player with information regarding their player account or other features at the gaming device 10 where the player is wagering. Additionally, multiple databases 90 and/or servers 80 may be present and coupled to one or more networks 50 to provide a variety of gaming services, such as both game/tournament data and player tracking data.

The various systems described with reference to FIGS. 1-3 can be used in a number of ways. For instance, the systems can be used to track data about various players. The tracked data can be used by the casino to provide additional benefits to players, such as extra bonuses or extra benefits such as bonus games and other benefits as described above. These added benefits further entice the players to play at the casino that provides the benefits.

Before now, these additional benefits were granted to players above and beyond the standard paytables, or standard game outcomes, of the base game played in the gaming device 10. Embodiments of the invention, however, in addition to operating as standard bonuses that can be paid above and beyond the base game 10 paytable, can be used to modify the outcome or paytable of the base game itself. Therefore, using embodiments of the invention, a casino or gaming system operator has greater control of game outcome, which provides the player a more enriching gaming experience that they enjoy more than a standard game.

As used in this description, the "base game" of the gaming device 10 can include only the main game played in the gaming device 10, or may additionally include any bonus game played in the top box 18 (FIG. 1A), display 20, secondary display 25, player tracking display 48, or elsewhere related to the gaming device 10.

Base game 10 paytables can be modified by sending codes from the gaming server 80 to the particular base game on the particular EGM 70-75 (FIG. 3) at which the identified player is playing. For example, with reference to FIG. 1A, a player identifies himself or herself to the base game 10, using the player tracking unit 45. Identification may include inserting a valid player tracking card or other identification process described above. With reference to FIG. 3, once the player is identified, the server 80 can send a token, signal, individualized paytable or bonus table, or other data that causes the EGM 70 to update its paytable based on the identity or other information associated with the identified player. The original paytable of the base game 10 may have multiple, selectable, pre-loaded variations that are selected by the downloaded data. The downloaded data may include a bonus table that is in addition to, rather than a part of the base game paytable. Generally, the new paytable has a higher payback schedule (i.e. lower casino hold percentage), which provides incentive to the player to play as an identified player. In some embodiments, there may be multiple new paytables for the base game 10, with varying payback percentages, although only one paytable would be active at any given time, i.e., for any given game.

The "cost" to a casino for providing greater benefit to a carded player, i.e., one who is identified to the gaming network 50, and not necessarily required to have a "card," can be borne by modifying the paytable of the base game 10. For instance, if the gaming regulators specify that the payback percentage must be between 0.75 and 0.95, and a particular base game 10 is set to have a 0.85 payback percentage, the casino could lower the payback percentage somewhat for non-identified players, and provide the carded players a greater benefit without cost or at a mitigated cost to the casino. This would have the tendency to provide even more incentive to players than they currently have to play as an identified player.

Thus, if the additional benefits granted to carded players were considered to be part of the base game 10 paytable, the casino could provide a lower payback percentage to non-identified players than for identified players, which would serve to encourage players to play as identified players. In other words, if one of the additional benefits was, for example, an extra spin, this could affect the paytable of the base game 10 because the extra spin is an additional chance to win a payback from the paytable. Therefore, providing benefits to carded players that affect the underlying base game 10 would need to be carefully analyzed, but measuring and defining appropriate parameters for such additional base game 10 benefits is not particularly more difficult than what game manufacturers and operators currently provide for calculating the payback tables of the base games 10.

The following disclosure describes various ways to provide benefits to identified players that may, in some embodiments, affect the base game paytable, and in other embodiments be separate from the paytable and instead instituted as another form of player bonus.

Figure 4:
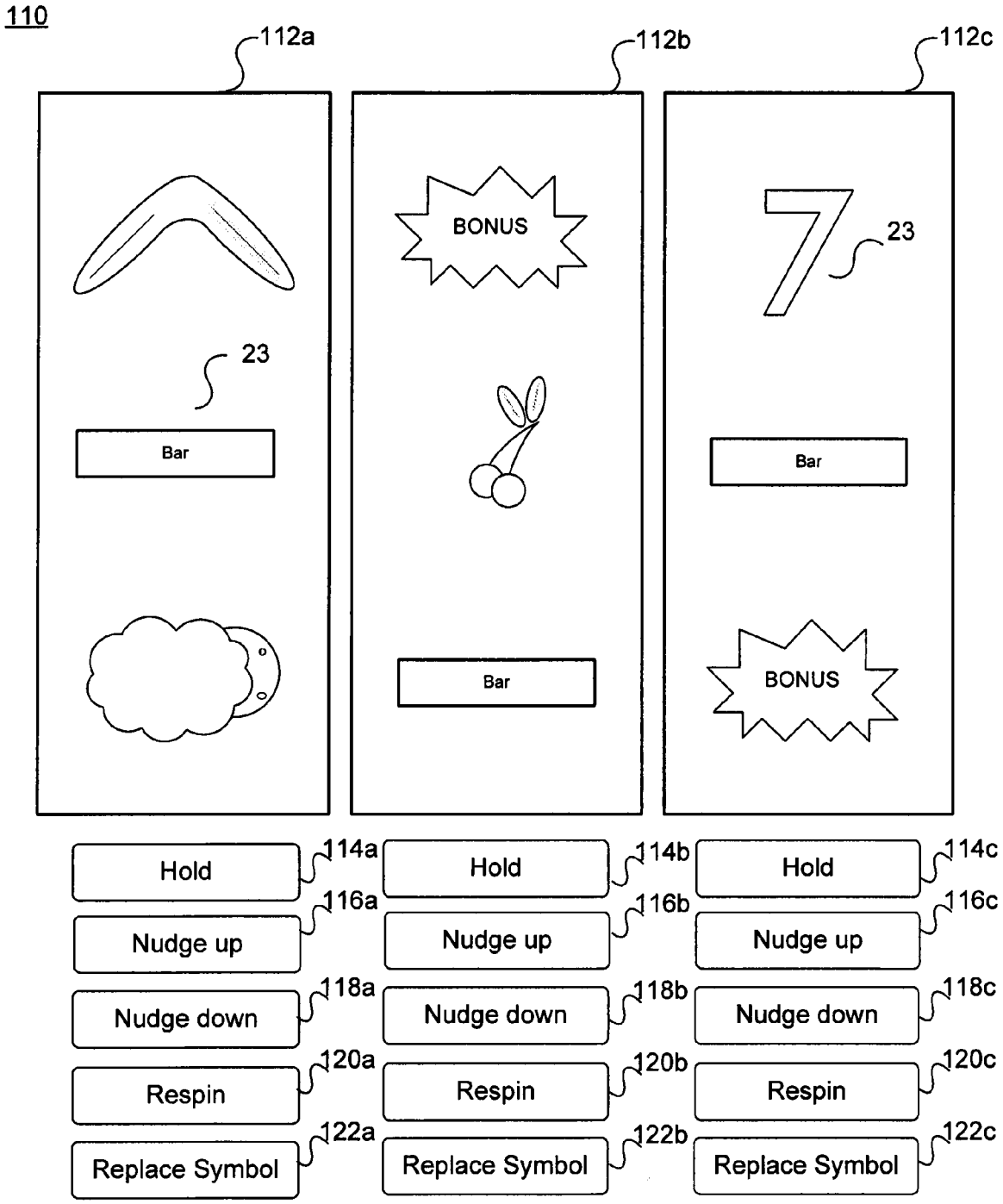
FIG. 4 is a detail diagram of three reels on a base game to illustrate embodiments of the invention.

FIG. 4 illustrates player options that can be presented to a player of a base game 10. The options include Hold, Nudge, Respin, and Replace symbol. Embodiments of the invention may include any or all of these options. Additionally, the options may be presented to the player on the display 20, the secondary display 25, the player tracking display 48, or elsewhere on the EGM 70-75 to be conveyed to the player. Illustrated in FIG. 4 are three reels 112*a*, 112*b*, and 112*c*, collectively referred to as reels 112. Additionally five sets of buttons are illustrated and similarly labeled: Hold 114, Nudge up 116, Nudge down 118, Respin 120, and Replace Symbol 122. Each of the sets of buttons appears below each reel 112 and controls its particular adjacent reel. Although a set of three video reels 112 are illustrated in FIG. 4, the Hold, Nudge, Respin and Replace options can be presented in a base game having any number of reels 112, be they physical or virtual video reels. Additionally, all of these concepts apply whether there are spaces between the symbols 23 on the reels 112 or not.

Although FIG. 4 illustrates a reel-type slot machine display, embodiments of the invention could equally apply to other types of games, such as video poker, bingo, keno, or other types of skilled or unskilled games.

Pressing one of the hold buttons 114 preserves the current status of its corresponding reel, card, number, or element during a subsequent spin or replay. For example, with reference to FIG. 4, the player may wish to hold reels 112*a* and 112*c*, and would therefore press the corresponding hold buttons 114*a* and 114*c*, provided the player was given the benefit to use two "holds." In some instances, a player may only be granted the privilege of using one hold, or one hold at a time. Assuming the player is granted two holds, during the next game, the reels 112*a* and 112*c* would not spin, but would rather stay in their current positions. Only the center reel 112*b* would spin. At the conclusion of the second spin, the player is awarded according to the payout table of the base game 10. Multiple "holds" could be awarded a player, so that the player could hold particular reels for however many "holds" had been granted. For instance, if six holds were granted, the player could freeze the reels a total of six times, in any combination, such as six spins where only one reel 112 is held, three spins where two reels 112 are held, etc.

Pressing the re-spin button 120 allows the player 120 to re-spin or replay the corresponding reel 112 without playing an entire new game, which provides the player an additional chance to secure a different outcome from the base game 10 paytable than without a respin. In other types of games, a new card is dealt, or a new number placed, for example. Similar to "holds" described above, a player may be awarded one or more re-spins, which can be used in any combination (within the limits specified by the game operator) until they are all used, or until they expire, described below. With reference to FIG. 4, the player may wish to respin the reel 112*b* to try to secure a winning BAR combination on the center payline.

Nudge is similar to re-spin, but allows the player to know the outcome of the nudging action. For instance, with reference to FIG. 4, pressing the nudge up button 116*b* would cause the reel 112*b* to rotate upwards, and place "bar" in the center payline. Nudge down works similarly, but in the opposite direction of "nudge up." Because the outcome of the nudge is known, nudge may be more valuable of a benefit to a player than hold or respin, and therefore fewer nudge actions may be presented to a player. In video poker, a "nudge" may provide a replacement with an 'adjacent' card, such as a "7" replaced by a "6" or an "8." A nudge may also cause the selection of another card at random. In other games, similar concepts can apply, for example selecting a bingo number that is one over or one under the original bingo number.

The Replace Symbol 122 button allows a player to replace a symbol 23 that appears on the base game 10 with a token or symbol "stored" in a player account. Recall with reference to FIGS. 1A and 3 that a player account is kept for each identified player on the database 90. In some embodiments of the invention an award of a "symbol" or multiple symbols are earned by the player, either as an achievement in a base game 10, or given to the player as a benefit or bonus, or awarded the player for any number of reasons, as described below. One or more user symbols can be used by the player to replace a symbol 23 that appears on the base game 10 during a game. For instance, with reference to FIG. 4, if the player has a "bar" symbol stored in his or her account, the player could press the Replace symbol button 122*b* to substitute the stored symbol for the cherries symbol that appeared when the spin ended. Pressing the Replace symbol button 122*b* may bring up a menu on the gaming display 20, secondary display 25, player tracking display 48, or elsewhere to allow the player to "remove" the symbol from the player account and "spend" it on the particular game. Replacing such a symbol allows the player to change a non-winning spin into a winning one.

When playing non-reel games, the symbols would match the possibilities of the game, of course. For instance, in video poker, the symbol could be a particular card.

Symbols may be specific, such as cherries or bar symbols, or general in nature, such as a "wildcard" symbol that could be used to replace any symbol on the reel 112. Another class of wildcard symbols, a "partial" or "limited" wildcard, could replace some but not all of the available choices. For example, with reference to video poker, a limited wildcard symbol could be any "heart," where the partial wildcard could be substituted for any card in the hearts suit, such as six of hearts. Other partial wildcard symbols could include any facecard, or any number in the "I" column of bingo. Multiple types of symbols could be earned, for instance, a player could accumulate six "cherries," four "bar" symbols, and one wildcard symbol. Indication of the symbols could be stored in the player account on the database 90 within the gaming network 50, and shown on the display 20, secondary display 25, and/or player tracking display 48. How symbols can be accumulated in a player account and how they expire is described below.

Figure 5A:
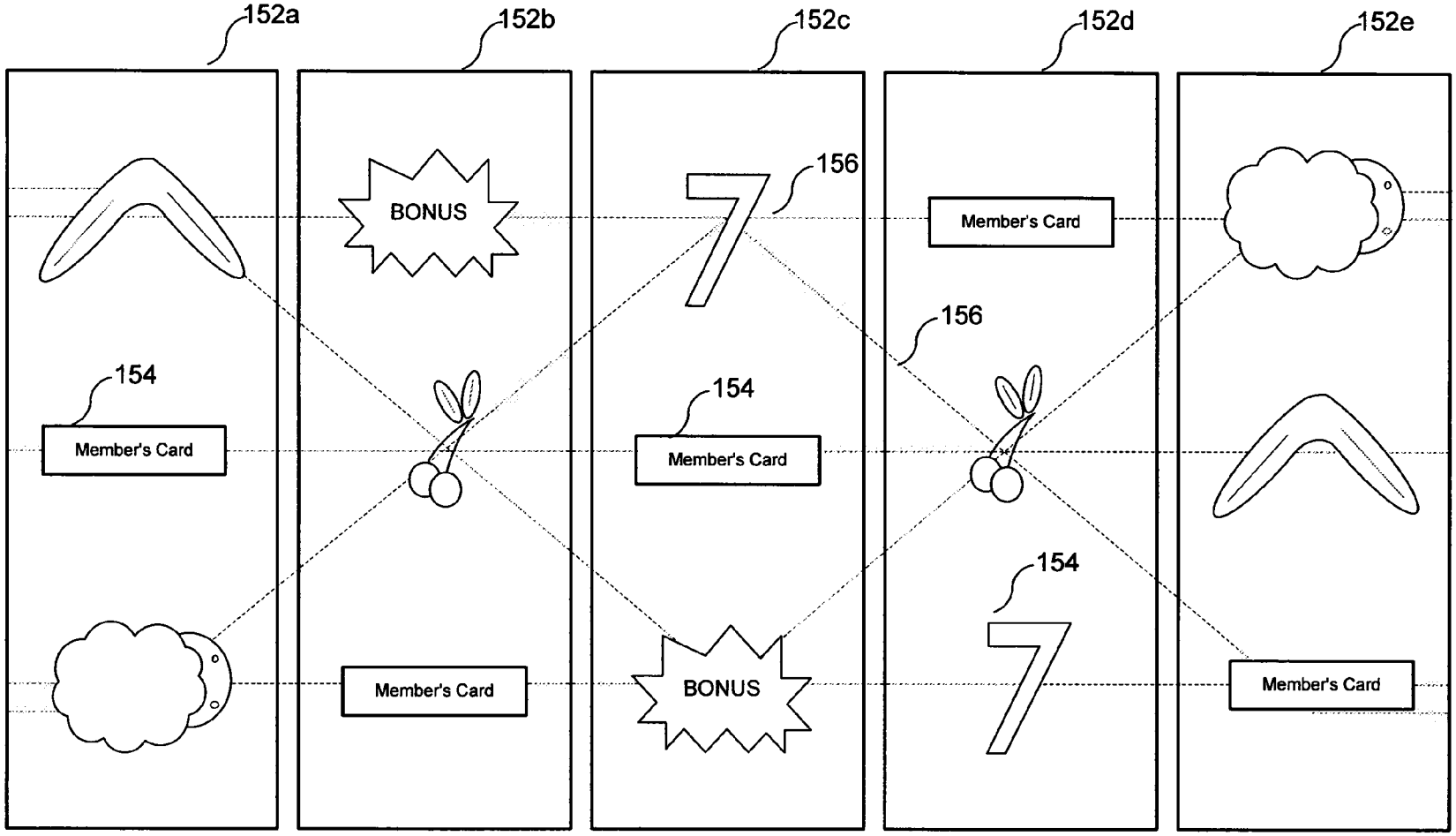
FIG. 5A is a detail diagram of five reels on a base game to illustrate embodiments of the invention.
Figure 5B:
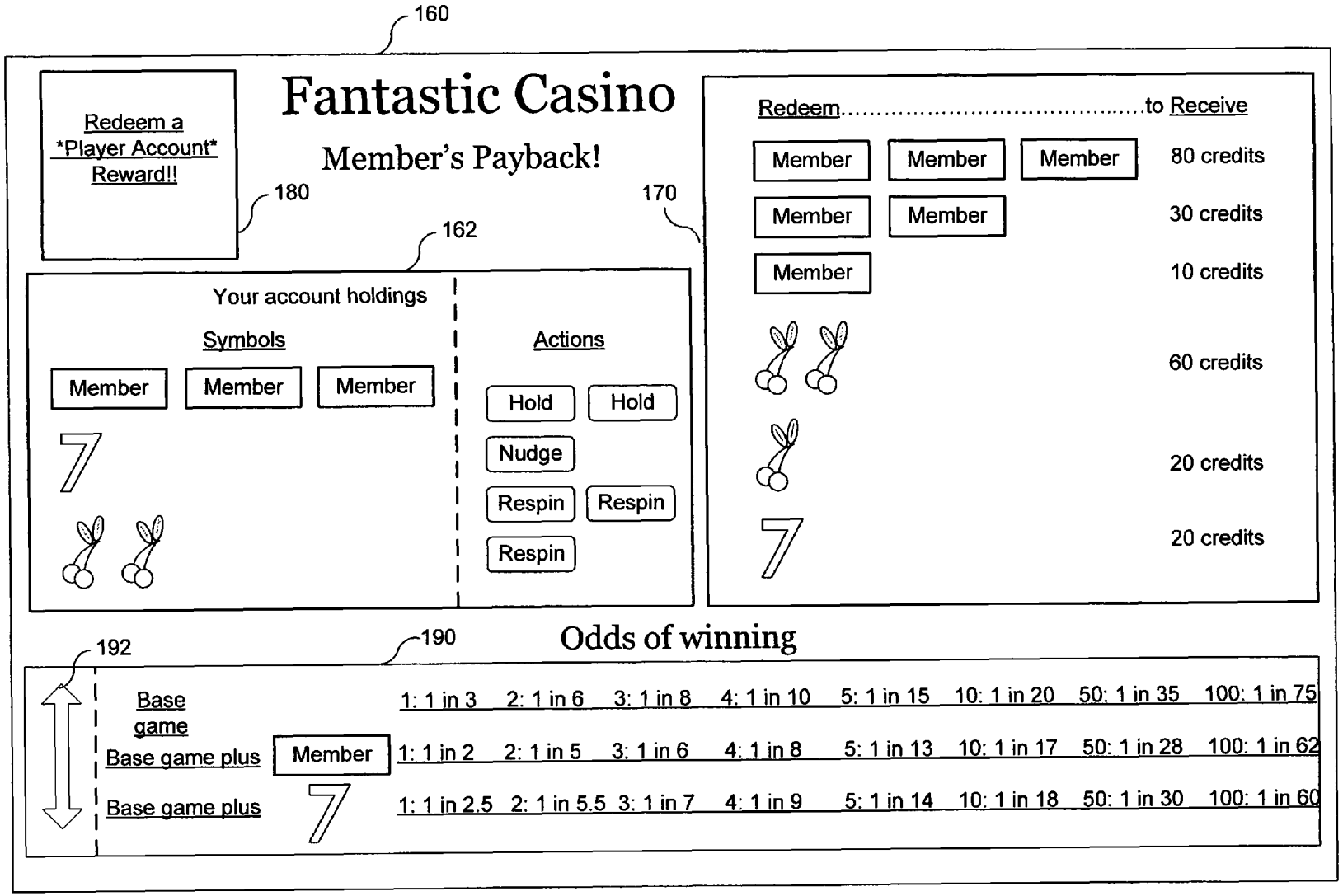
FIG. 5B is a block diagram illustrating a player benefits screen according to embodiments of the invention.

One particular example illustrating a game with wildcards is illustrated in FIGS. 5A and 5B. In FIG. 5A, a five-line video reel is illustrated on a screen 150, with five reels 152*a*-152*e*, each with three symbols. In this particular game, there are three symbols 154 on each reel 152, and there are five paylines 156. Players win when they match symbols along one or more of the paylines 156. Additionally, players can win when a minimum number of the same symbols, such as 5 "member card" symbols, appear anywhere on the five reels 152, with additional payouts for more than five symbols, which is referred to herein as a "scatter pay".

FIG. 5B is an example of a communication screen 160 shown to a player on a display 25 or 48 of an EGM 10 (FIG. 1A). The communication screen 160 is a real-time indicator of the holdings of a player account for the particular game being played on the base game 10. In this particular game, the casino wishes to encourage that players play as identified players, i.e. members of a "player's club," and the communication screen 160 is only shown to players who choose to play as identified players.

A "holdings" section 162 of the screen 160 provides an indication of the account holdings specific to the identified player. In this example, the player has accumulated benefits including five tokens or symbols, a "7," symbol a "bar" symbol, and three "member card" symbols. The symbols can be accumulated as described above. The holdings section may include an expiration time indicator (not illustrated), i.e., how long the symbols are available to the player, termed in numbers of future games and/or time duration, or any of the expiration rules described above.

An "options" section 170 of the screen 160 informs the identified player of the playing options the player has in redeeming any or all of the symbols or tokens accumulated in the player's holdings section 162. For instance, the options section may illustrate that by playing two "member card" symbols, the player qualifies to win the screen pay worth 30 credits, and by playing three "member card" symbols, the player can win an enhanced reward of 80 credits.

A redemption section 180 provides the player an opportunity to redeem one or more player symbols that have been accumulated in the player account. Further, an odds section 190 illustrates the odds of winning certain combination with what is already in the player account. Because the benefits to the identified player exceed those of a non-identified player, the odds of winning shown in the odds section 190 should be higher than those of an unidentified player.

Any of the sections 162, 170, 180, 190 may include multiple or scrolling screens if the information to be shown to the player exceeds the section space. An example scrolling mechanism is illustrated as 192, which allows the player to scroll the section 190.

In operation, as the player accumulates benefits, such as the symbols or actions described above, the options section 170 and odds section 190 are updated. These sections may be updated with each game played or periodically. When the player desires to redeem a symbol or other benefit, the player uses the redemption screen to remove a symbol or benefit from their account and exchange it for the payback rewards illustrated in the options section 170, or for another chance at winning.

In addition to the benefits awarded to a player described above, which are redeemed by particular player action with particular buttons 114, 116, 118, 120, and 122, the identified player could also be awarded benefits without requiring special input for redemption.

As described above with reference to FIG. 2B, the player of a base game 10 can select a number of paylines by selecting the appropriate payline button 32B. Additionally, the player can select the number of credits he or she wishes to wager per payline. Each of these selections, payline and credits per payline typically has an additional cost to the player over the minimum wager for the base game 10. Embodiments of the invention grant the identified player some or all of these benefits in the base game 10, without extra cost to the player, or with a reduced cost, as an extra reward for playing as an identified player.

For example, the identified player may be entitled to one additional payline for the next ten games, either for free or for a smaller cost than the typical cost for the additional payline. In another example, the identified player may be given three free additional paylines for the next 5 minutes. In a further example, a player can be compensated as if he or she was playing "max bet," even though the player was only paying for one or two credits. Some pay combinations or special paylines may be available only to those players who are identified, i.e. carded players. In other embodiments, entire games may be available only to players who are valued above a minimum threshold. For instance, some games may be available only to players who play as identified players, and non-identified players are not allowed to play. Other games may be available only to players who have had player accounts for a minimum period of time, for example six months. Other games may be limited to "high-roller" players who play often or who are otherwise determined to be valuable to a casino.

In other embodiments, player benefits may take the form of "helps" or "hints" that are displayed to the identified player as the game progresses. For instance, when playing video poker, odds of winning when particular cards are discarded and replaced can be displayed to the identified player. Another player benefit may be notice to the player that a particular minimum level of payout will occur within the next 30 games. If the player continues to play for the 30 games, the player is guaranteed to win the displayed minimum payout. In implementation, the player tracking system may "watch" the underlying base game 10 for those 30 games. If the payout exceeds the minimum level, then the player tracking system pays nothing over and above the paytable of the base game 10. If, on the other hand, the base game 10 has not met the minimum payout level promised the identified player, then the player tracking system pays the player the deficiency, either directly through the player rewards system described above, in a separate bonus, or through the base game 10. In the last example, the player tracking system can perform such an action by sending a command from the server 80 to the EGM 70-75 on which the player is playing. The command may cause the base game 10 to pay the minimum award directly to the account, such as through the coin meter. In another method, the command from the server 80 may cause the base game 10 to display a "winning" combination, and pay the related payout, even though the base game 10 would have normally been a non-winning (or lower winning) outcome.

A further benefit that can be provided a player is discount or free tickets or awards to another type of game or a game in a different part of the casino, or even at a different casino property. For instance, if the gaming network 50 determines from looking at history stored on the database 90 that a particular player generally plays mechanical slots, the player could be awarded a ticket that can be redeemed for three free games on a video slot machine. Or the player can be awarded a ticket that makes every play on a promoted machine into a "max bet," regardless of the number of credits the player wagers. Other embodiments do not require a physical ticket, but rather receive a free or discounted game or series of games simply by identifying themselves to the new game. For example, the identified player is playing video reel slots and the player tracking system encourages the player to try video poker by presenting three free games in a message on one of the screens of the EGM 70-75. To redeem the offer, the player need only go to a video poker machine, identify himself or herself, and the video poker machine awards three free credits to the player.

Each of the player benefits described above can be granted to identified players based on certain criteria. In the most straightforward case, some or all of these benefits may be granted to an identified player simply for being identified. Stated differently, players may be given some or all of these advantages as additional incentives to play as an identified player. In such a case, simply inserting the player identification card would give the player, for example, two "holds," one "nudge," two "respins," two reel symbols and one wildcard symbol. These incentives would remain in the player account stored on the database 90 and available to the player until the player uses them, or until they otherwise expire as described below.

When discussing accumulation and expiration of benefits or advantages, hereinafter referred to as benefits, it is understood that the benefits refer to any of the benefits discussed above, or any other benefit provided to the player.

As described above, benefits may be presented to the player for simply playing as an identified player. Additionally, the benefits may accumulate based on other factors. For example, the benefits may be presented to the player only during certain times of day, such as very early in the morning, e.g. from 5:00 am to 6:30 am to promote casino play during typical non-busy times. The benefits may be presented at various times of the day, such as only between 7:00-9:00 am and 7:00-9:00 pm to promote return play.

Benefits may accumulate according to a set schedule, such as a new symbol for every 100 credits played, or may include a "mystery" element. In the "mystery" scenario, a new symbol is awarded at a rate of 1 new symbol for every 100 credits, as an average, although the actual symbol may be awarded at any time. For example, a player may earn a first symbol at 67 credits, but then not win another for another 140 credits played. Over time, the award rate will average to one symbol per every 100 credits played, but the excitement of not knowing when such benefit will be awarded may heighten game playing excitement.

In some embodiments, benefits are awarded not based on hard start or stop times, but as a function of time. More specifically, there could be a benefit "multiple" of a baseline benefit rate. At times the casino or game operator wishes to provide additional benefits, the multiple is increased, such as during the time periods above, or other times that the casino wishes to encourage play. At times the casino wishes to minimize the amount of benefits earned, the multiplier can be reduced. If the casino wishes to reduce the benefits to an absolute minimum, the multiplier could be reduced to a zero, which is the equivalent of a time period where benefits do not accumulate. Programmatic controls could provide minimum and maximum benefit levels. In other words, if the benefit rate calculated by the system described above exceeded the programmed maximum, the player would be awarded only at the maximum rate.

In other embodiments, the minimum and maximum levels can be changed based on the desires of the casino. For instance, during a player visit, the rewards system may provide increased benefits for a first time period, then decrease them for a second time period then increase them again for a third. In one example, the rewards system could always ensure that the player receives a minimum bonus within the first 20 games the first time the player plays as an identified player. In other embodiments, the rewards system could be scheduled to reduce the awards rate after the time spent in the casino, measured either in number of games or number of minutes exceeds a pre-determined threshold. Players may be invited to specify a period (in time, number of games, or spending limits, for example) to the casino after which the casino reduces the benefits, to encourage the player to spend only a set time playing. Of course, any of these periods may include multiple sub-periods within them, each with a different benefit level, such that the benefit level is almost always changing or being evaluated for change.

Benefits may be awarded based not only on time of day, but also on particular days of the week, weeks of the year, holidays, non-holidays, weekdays, weekends, etc. For example, a casino may provide extra benefits during weekend buffers, such as Friday and Mondays. A casino may advertise the fact that benefits are enhanced during particular promotions to raise player participation, or it may keep such benefit enhancement times secret from the players.

In the most general embodiment, benefits could be earned and spent (redeemed) during the same periods in which they are earned. In other embodiments, benefits are earned during a "benefit earning" period and can only be redeemed during a "benefit spending (or redeeming) period." For example, in a two hour period, the player may accumulate benefits during the first 90 minutes, but only be allowed to redeem them during the final 30 minutes. Or benefits may accumulate as they are earned or awarded, and then be eligible to be redeemed only within a fixed number of games. In other embodiments, the casino could allow a player to accumulate benefits during a first visit, then require that the player return, after a minimum waiting time period, in order to redeem them. As can be understood, any combination of duration times, wait times, number of games, etc. can be implemented in various embodiments of the invention.

Benefits may be provided based on the number of visits per day, or after a certain play duration in a particular time period (such as day, days, week) that the player continues to play as an identified player. For example, the player may accumulate one wildcard symbol after 88 minutes of play in a first session, and an additional wildcard after 150 minutes in a second session, but only if the time between the first and second session exceeded a time threshold, such as three hours.

In each of the described embodiments, a minimum level of play may be required for the play to qualify or "count." In other words, the benefit system may require that the player play "max credits" for all spins to accumulate benefits. The system may alternatively or additionally require that the player play a minimum number of games per time unit, such as a minimum of three games per minute. In yet another embodiment, the benefit system may "count" all play as meeting the minimum play rate necessary to qualify for benefits, but provide additional benefits that the casino would like to promote for those players who are wagering more or based on other factors described above. Further, some benefits may be provided for all players, while other benefits provided only for those players meeting a minimum requirement threshold. In still another embodiment, the qualification to receive benefits may be a minimum number of games, no matter how long the player takes to play that minimum number.

Another criterion for accumulating benefits can be based on the historical value of a player. Casinos have long attributed "value" of a player based on various criteria, such as number of past visits, frequency of visits, rate of play, rate of wagering, number of "max bets" per hour, etc. A casino may implement a benefit system that only awards benefits to the highest 15% of valued players, or the highest 90% of valued players, or simply on a player by player determination. A casino that has multiple properties may provide benefits at a different rate depending on which property an identified player is playing.

Benefits may be awarded based on individual play patterns and styles. For instance, if past history indicates that the identified player cashes out after five successive losses, then a benefit could be granted that boosts a chances of a win after a fourth consecutive loss. In another example, every detail of game interaction from the time a player is identified until the player cashes out is recorded and analyzed for ways to apply benefits, as described above, at various times to encourage the player to continue to enjoy his or her experience. When trends or events that cause the player to stop enjoying playing are identified, benefits can be granted to the identified player as those trends or events unfold, which boosts player enjoyment. In general, any data generated by or about an identified players interactions with the gaming device 10 can be stored, classified, analyzed, and a response made in the form of benefits awarded to the player to try to enhance the player experience.

In one example, as the time interval between button pushes increases, which may indicate player fatigue or disinterest, the benefits level can be increased, or specific benefits can be immediately awarded. In another example, when a player changes his or her wagering style, such as changing to 'bet 1' from 'max bet,' different benefit awards may be given. In another example, if the player's history tends to show that they play $20 at each setting, particular awards may be given as the player nears this amount. In a further example, the player may be awarded if the player has a particularly long streak of non-wins, in terms of time or number of games. In yet another example, if the system determines that the player typically cashes out because of a win, the player can be provided a benefit that encourages him or her to continue, such as credits that must be immediately played or they automatically lapse.

Benefits may also be awarded based on a "projected" value of the player. For instance, a casino may have information about other players in the newly identified player's zipcode, and believes that the new player will be valuable. The casino may award the new player at a rate of a valued player, even though no player history has been accumulated, based on this "projected" value. In addition to zip code, other factors could be used, such as street address, group affiliation, such as fraternal organizations, age, gender, marital status, etc. As more information is becoming available on public sources such as the internet, the gaming network could couple to information sources through the Internet 62 (FIG. 3) to find additional information about a player even though it was not provided to or gathered by the casino. Public records such as house values, property taxes, personal property holdings, credit score, profession, criminal record etc. could factor into the casino's decision as to the projected value of a player, and base or determine a rate at which to grant benefits. Third-party information could also be used, such as agglomerated credit card data for particular zip codes, what magazines the player subscribes to, and other data available for analysis to determine trends and projected values of players, among other reasons.

Benefits may be awarded to a player based on special times particular to the player, such as the first time a player plays as an identified player. Other benefits particular to the player may include birthdays, anniversaries, etc.

Benefits may be award to players based on other factors relevant to a casino or game operator, such as weather. For instance, if it is a relatively good weather day, casinos could encourage play by raising a benefit rate for the players. In another example, if there is poor weather and the casino is relatively full, the benefit rate may be reduced. The gaming network 50 may couple to a weather service or weather station over the internet 62 (FIG. 3) to determine the present weather on which to base its decision.

As described above, benefits accrued by players may be used during "benefit spending" times, and not at other times. This redemption period may also include a limit on how many benefits can be used in a given time period. For example, the gaming network 50 may accrue six separate benefits stored in a player account on the database 90, but only allow one benefit to be redeemed every 15 minutes, or every 8 games or wagers, for example. Benefits may be valid for a given number of games, for example 185, no matter when those games are played. For example, a player may play in the morning, acquire benefits that expire in 185 games, leave for lunch, and, when the player returns in the afternoon or in a month, those benefits are still valid, having been stored in the player's account. Additionally, benefits accrued by the player may have expiration dates—a time at which they permanently expire and are no longer available to the player until earned again. For example the player may accumulate three "bar" symbols, to be used for symbol replacement as described above with reference to FIG. 4, but require that those particular benefits be used by the player by midnight on the same day that they were acquired. After midnight, the three "bar" symbols, if unused, would be deleted from the player account. In another embodiment, a nudge could be awarded that expires at the earlier of 200 games or 48 hours.

Benefits may expire for a number of reasons, such as time limits or playing limits as described above. Benefit expiration may also be tied to other events such as check-out of a casino hotel. In such a system, the identified player could use benefits provided the player was a guest at the casino hotel, but checking out of the hotel would cause the benefits to expire. Benefits could expire if the player drops below a minimum playing threshold, or a minimum rate of play. Benefits could expire after the player exceeds a given payback percentage, such as 3.5 times the player's coin-in. In such a system, if for example the player had a coin-in of $250, benefits could accrue (and be used by the identified player) until the player had combined winnings of $875. The limits can be continually calculated and updated by the game server 80 and communicated over the gaming network 50.

Figure 6:
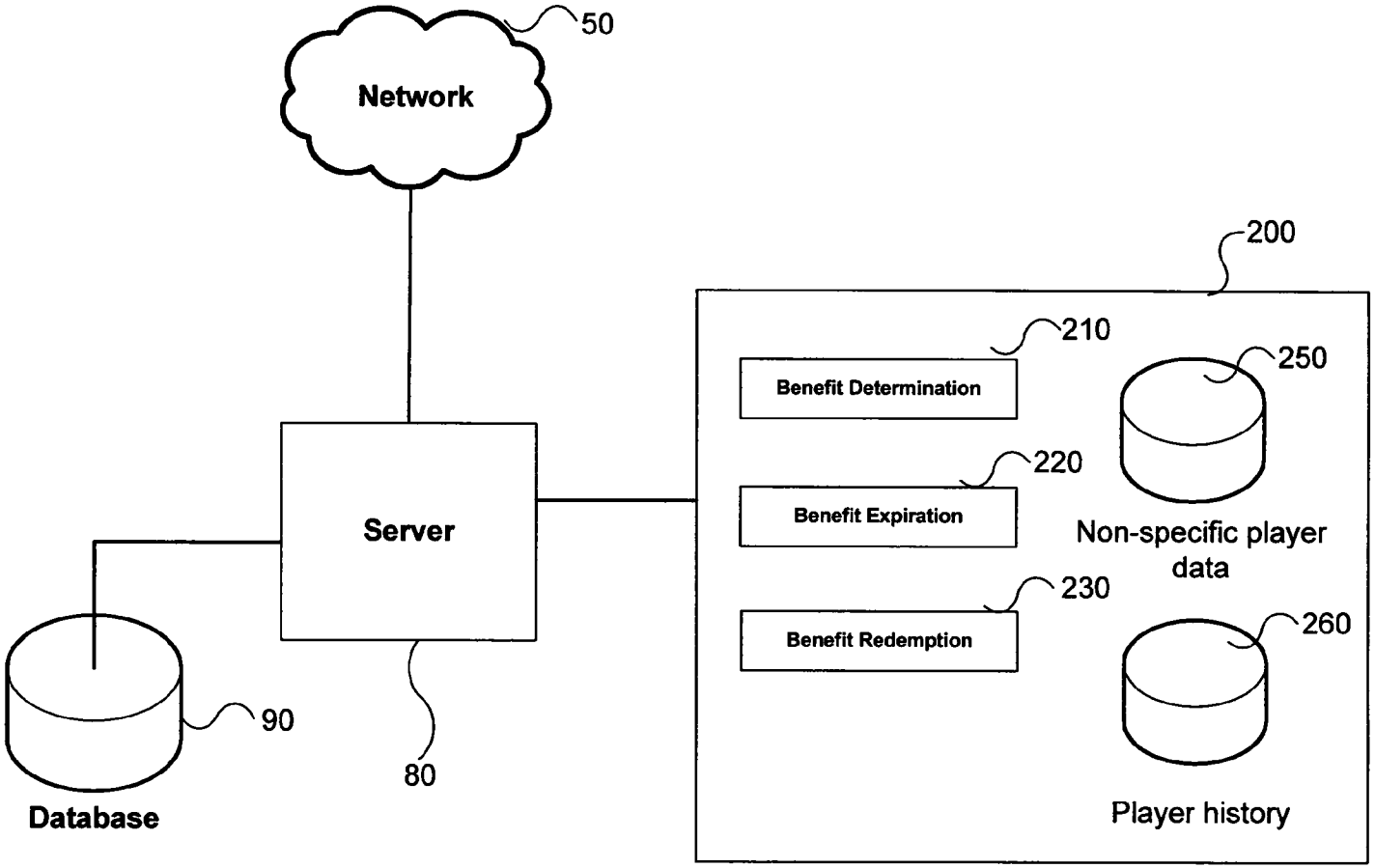
FIG. 6 is a functional block diagram of a portion of a gaming network in conjunction with the network illustrated in FIG. 3 according to embodiments of the invention.

FIG. 6 illustrates an embodiment of a player benefit system 200 having the functionality as described above. The player benefit system 200 may be separate from or wholly contained within the player server 80, and is coupled to the player database 90. The player benefit system 200 connects directly or indirectly to the gaming network 50, and in turn to the elements illustrated in FIG. 3. In some embodiments, the player benefit system 200 includes a facility for benefit determination 210, benefit expiration 220, and benefit redemption 230. Each of these facilities may include subcomponents. For example, the benefit determination facility 210 may include a portion that determines player value, and a portion that generates the signals to communicate the benefits to the EGM on which the player is playing. Further, any or all of these components 210, 220, 230 may be coupled to a player history database 240, and a non-specific player database 250.

In operation, when the player inserts his or her identification card, the player is identified by referencing the database 90 or 240, or a combination. The benefit determination facility 210 calculates or otherwise selects the desired benefit level to apply to the player, at that particular time, and sends codes, data, tokens, or a specific paytable itself over the network 50 to the player's EGM.

During play, benefits are determined or selected, based on the benefit determination facility 210 and provided to the player's account, such as on the database 240. The player is notified of the benefit awarded by a message on one of the screens on the EGM, or other methods as described above. Benefit redemption occurs through the redemption facility 230 as awards are used by the player. Benefit expiration is handled by a separate facility 220.

As is known by those with skill in the art, each of the facilities 210, 220, 230 may be implemented as stand alone or combined computer hardware components, such as Application Specific Integrated Circuits (ASICs), or could be stand alone or combined software components running on general purpose or specialty processors. Databases of data can be stored on spinning media, solid state, or other media.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

What is claimed is:

1. A player compensation system coupled to an electronic slot machine having a plurality reels on which symbols appear, a subset of the symbols comprising an outcome of a game played on the slot machine after reels spin in response to a player input to the electronic slot machine, the player compensation system comprising:

a player identifier;

a collection of benefits accumulated by an identified player as a function of outcomes of games during multiple plays of games on the electronic slot machine, the function of outcomes of games comprising a predetermined number of successive losses and the collection including at least one selected from the group comprising the ability to nudge a selected reel to change the game outcome, the ability to respin a selected reel to change a game outcome, the ability to hold a selected reel in a current reel position while at least one other reel spins to generate another game outcome, and the ability to replace a reel symbol in a game outcome with a different symbol;

a storage device for storing the accumulated benefits;

a screen for displaying:

a plurality of the benefits accumulated by the identified player, including at least one of the respin, hold, and replace abilities and at least one symbol available to replace a reel symbol using the replace ability, and a number of credits the player qualifies to win for redeeming each of the displayed benefits;

a memory having computer code therein that implements a process for determining an expiration time for at least one of the benefits, the expiration time being a function of a predetermined elapsed time; and an actuator associated with one of the reels for implementing one of the stored benefits in response to player actuation of the actuator after one game selected by the player from a plurality of games played.

2. The player compensation system of claim 1 in which the at least one of the collection of benefits is an extra payline.

3. The player compensation system of claim 1 in which at least one of the collection of benefits is a hint.

4. The player compensation system of claim 3 in which the hint is a display of odds of winning when one of the displayed benefits is redeemed.

5. The player compensation system of claim 1 in which the ability to replace a reel symbol in a game outcome with a different symbol comprises the ability to replace a reel symbol in a game outcome with a wildcard symbol.

6. The player compensation system of claim 1, further comprising a player qualification component, and in which the collection of benefits is accumulated only by qualified players.

7. The player compensation system of claim 6 in which all identified players are qualified players.

8. A method of compensating a player of networked electronic slot machines each of which has a plurality of reels on which symbols appear, a subset of the symbols comprising an outcome of a game played on the slot machine after reels spin in response to a player input to the electronic slot machine, the networked electronic slot machines being in a gaming system coupled to a player tracking system, comprising:

awarding a plurality of player benefits to an identified player of one of the gaming devices, the benefits including at least one selected from the group comprising the ability to nudge a selected reel to change the game outcome, the ability to respin a selected reel to change a game outcome, the ability to hold a selected reel in a current reel position while at least one other reel spins to generate another game outcome, and the ability to replace a reel symbol on a selected reel in a game outcome with a different symbol;

accumulating the plurality of awarded benefits as a function of outcomes of multiple games played on the electronic gaming machine and associating the benefits with the identified player;

storing the accumulated benefits in a memory coupled to the network;

displaying the accumulated benefits to the player, comprising displaying:

a plurality of benefits including at least one of the respin, hold, and replace abilities and at least one symbol available to replace a reel symbol using the replace ability, and a number of credits the player qualifies to win for redeeming each of the displayed benefits;

permitting the player to play games on one of the electronic gaming devices;

permitting the player to select one of the games;

permitting the player to select one of the reels after the selected game;

implementing at least one of the accumulated benefits for the selected reel responsive to an input to the electronic slot machine by the player;

removing at least one of the accumulated benefits after a predetermined number of games is played; and awarding the player benefit only if the identified player is playing above a threshold rate, the threshold rate comprising playing games at a faster rate than a minimum rate of game play.

9. A player compensation system coupled to an electronic slot machine having a plurality reels on which symbols appear, a subset of the symbols comprising an outcome of a game played on the slot machine after reels spin in response to a player input to the electronic slot machine, the player compensation system comprising:

a player identifier;

a collection of benefits accumulated by an identified player as a function of outcomes of games during multiple plays of games on the electronic slot machine, the collection including at least one selected from the group comprising the ability to nudge a selected reel to change the game outcome, the ability to respin a selected reel to change a game outcome, the ability to hold a selected reel in a current reel position while at least one other reel spins to generate another game outcome, and the ability to replace a reel symbol in a game outcome with a different symbol;

a storage device for storing the accumulated benefits;

a screen for displaying:

a plurality of the benefits accumulated by the identified player, including at least one of the respin, hold, and replace abilities and at least one symbol available to replace a reel symbol using the replace ability, and a number of credits the player qualifies to win for redeeming each of the displayed benefits;

a memory having computer code therein that implements a process for determining an expiration time for at least one of the benefits, the expiration time being a function of a predetermined elapsed time;

an actuator associated with one of the reels for implementing one of the stored benefits in response to player actuation of the actuator after one game selected by the player from a plurality of games played; and a memory having computer code therein that implements a process for determining play above a threshold rate and permitting benefit accumulation only for play above the threshold rate, wherein play above a threshold rate comprises playing games at a faster rate than a minimum rate of game play.

10. The player compensation system of claim 9 in which the at least one of the collection of benefits is an extra payline.

11. The player compensation system of claim 9 in which at least one of the collection of benefits is a hint.

12. The player compensation system of claim 11 in which the hint is a display of odds of winning when one of the displayed benefits is redeemed.

13. The player compensation system of claim 11 in which the ability to replace a reel symbol in a game outcome with a different symbol comprises the ability to replace a reel symbol in a game outcome with a wildcard symbol.

14. The player compensation system of claim 11, further comprising a player qualification component, and in which the collection of benefits is accumulated only by qualified players.

15. The player compensation system of claim 14 in which all identified players are qualified players.

16. A method of compensating a player of networked electronic slot machines each of which has a plurality of reels on which symbols appear, a subset of the symbols comprising an outcome of a game played on the slot machine after reels spin in response to a player input to the electronic slot machine, the networked electronic slot machines being in a gaming system coupled to a player tracking system, comprising:

awarding a plurality of player benefits to an identified player of one of the gaming devices, the benefits including at least one selected from the group comprising the ability to nudge a selected reel to change the game outcome, the ability to respin a selected reel to change a game outcome, the ability to hold a selected reel in a current reel position while at least one other reel spins to generate another game outcome, and the ability to replace a reel symbol on a selected reel in a game outcome with a different symbol;

accumulating the plurality of awarded benefits as a function of outcomes of multiple games played on the electronic gaming machine and associating the benefits with the identified player, wherein the function of outcomes during multiple plays of games on the electronic slot machine comprises a predetermined number of successive losses;

storing the accumulated benefits in a memory coupled to the network;

displaying the accumulated benefits to the player, comprising displaying:

a plurality of benefits including at least one of the respin, hold, and replace abilities and at least one symbol available to replace a reel symbol using the replace ability, and a number of credits the player qualifies to win for redeeming each of the displayed benefits;

permitting the player to play games on one of the electronic gaming devices;

permitting the player to select one of the games;

permitting the player to select one of the reels after the selected game;

implementing at least one of the accumulated benefits for the selected reel responsive to an input to the electronic slot machine by the player; and removing at least one of the accumulated benefits after a predetermined number of games is played.

* * * * *